US009784219B2

(12) United States Patent
Herzer et al.

(10) Patent No.: US 9,784,219 B2
(45) **Date of Patent: *Oct. 10, 2017**

(54) CARBURETOR ARRANGEMENT

(71) Applicant: Bernardo J. Herzer, Culver City, CA (US)

(72) Inventors: Bernardo J. Herzer, Culver City, CA (US); David Kostka, San Pedro, CA (US)

(73) Assignee: Bernardo J. Herzer, Culver City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/544,227

(22) Filed: Dec. 11, 2014

(65) Prior Publication Data

US 2016/0195040 A1 Jul. 7, 2016

Related U.S. Application Data

(63) Continuation of application No. 12/462,310, filed on Aug. 3, 2009, now Pat. No. 8,511,286, which is a continuation of application No. 13/987,504, filed on Aug. 1, 2013, now Pat. No. 9,097,212.

(51) Int. Cl.

| | |
|---|---|
| ***F02B 43/00*** | (2006.01) |
| ***F02M 9/02*** | (2006.01) |
| ***F02M 17/20*** | (2006.01) |

(52) U.S. Cl.
CPC ..... *F02M 9/02* (2013.01); *F02M 17/20* (2013.01)

(58) Field of Classification Search
CPC ..... F02M 19/04; F02M 9/02; F02M 5/125
USPC ..... 123/525, 527, 685, 699, 700, 701; 261/36.2
See application file for complete search history.

(56) References Cited

U.S. PATENT DOCUMENTS

| | | | | |
|---|---|---|---|---|
| 2,610,024 A * | 9/1952 | Wirth | F02D 9/00 | 251/297 |
| 2,904,877 A * | 9/1959 | Edelen | F02M 5/125 | 251/333 |
| 8,511,286 B2 * | 8/2013 | Herzer | F02M 9/02 | 123/527 |

* cited by examiner

*Primary Examiner* — Hung Q Nguyen
(74) *Attorney, Agent, or Firm* — Morrison & Foerster LLP

(57) ABSTRACT

A carburetor for a gas powered internal combustion engine having a plurality of pressure reducing stages for reducing the pressure of the gas phase in a liquified petroleum gas storage bottle prior to the mixing of the gas phase of the liquified petroleum gas with ambient air.

37 Claims, 14 Drawing Sheets

DETAIL B
OPEN

DETAIL B
CLOSED

DETAIL A

DETAIL C
OPEN

DETAIL C
CLOSED

CARBURETOR ARRANGEMENT

REFERENCE TO RELATED APPLICATIONS

This Application is a continuation of our prior patent application Ser. No. 13/987,504, filed Aug. 1, 2013 which is a continuation of application Ser. No. 12/462,310, filed Aug. 3, 2009, now U.S. Pat. No. 8,511,286, issued Aug. 20, 2013

BACKGROUND OF THE INVENTION

Field of the Invention

This invention relates to the carburetor art and more particularly to a carburetor for a liquified petroleum gas, such as propane, powered internal combustion engine for providing a multi-stage pressure reduction of the gas phase of the liquified petroleum gas contained in a liquified petroleum gas storage bottle which contains both the liquid phase and the gas phase of the liquified petroleum gas and metering the amount of the gas for mixing of the gas with ambient air before introduction of the gas/air mixture into the internal combustion engine.

Description of the Prior Art

Carburetors of various configurations have heretofore been utilized in connection with providing metered amounts of fuel with air, at either ambient pressure or supercharged, to provide a fuel/air mixture before introducing the fuel/air mixture into, for example, the intake manifold of an internal combustion engine for distribution of the fuel/air mixture to the cylinders of the internal combustion engine. While the advent of direct fuel injection of the fuel into the cylinders of the internal combustion engine has decreased the use of carburetors for many liquid fuel, such as gasoline, powered devices, there are still many applications wherein a carburetor may be economically advantageous utilized.

In gasoline powered internal combustion engines, utilizing a carburetor to mix the gasoline with the air, in general the liquid gasoline is mixed with the air in the carburetor and the liquid gasoline/air mixture flows from the carburetor into an intake manifold of the internal combustion engine. From the intake manifold the liquid gasoline/air mixture is introduced into the individual cylinders of the internal combustion engine. In each cylinder, some or all (depending on the type of engine) of the liquid gasoline is converted into the vapor stage where a spark plug ignites the mixture to provide the power stroke of the piston in the cylinder. The carburetor is generally connected in gas flow communication to the intake manifold so as to be substantially heat isolated from the intake manifold and the internal combustion engine since heating the carburetor might cause the gasoline to convert into the vapor phase in the carburetor which would "vapor lock" the carburetor and prevent the introduction of the desired metered amount of flow of liquid gasoline for mixing with the ambient air.

One present use of carburetors, however, is in the field of gas phase powered internal combustion engines wherein the fuel is the gas phase of a liquified petroleum gas. The containers of the liquified petroleum gas contain both liquid phase and gas phase of the liquified petroleum gas which, for example may be propane. The pressure of the gas phase of the liquified petroleum gas in the container may be on the order of 150 pounds per square inch and, as such, the pressure must be reduced before the metered amount of gas may be mixed with the air to provide the desired mixture of gas/air for introduction into the cylinders of the internal combustion engine. In the prior art a separate pressure regulator has generally been utilized to provide the desired reduction in the gas pressure. However, a separate pressure regulator has often introduced complications in the design of the fuel system for such gas powered internal combustion engines. One such complication is the instance of the liquid being introduced into the regulator. In such instances, generally the liquid phase will convert into the gas phase. In so converting to the gas phase, the regulator will be cooled as the liquid absorbs heat from the structure of the regulator and the performance of the regulator will be erratic. Should such introduction of liquid of the liquid phase into the carburetor continue long enough, there will be no conversion of the liquid phase to the gas phase and the liquid phase of the liquified petroleum gas will remain in the regulator. Since the internal combustion engine is designed to operate on the gas phase, and not the liquid phase, as the fuel in the fuel/air mixture, the engine would cease functioning until the gas phase in the correct metered amount is mixed with the air.

Thus, there has long been a need for a fuel system for gas powered internal combustion engines wherein both the pressure regulation of the gas, the metering of the gas flow and the combining of the metered gas flow with the air is accomplished in a single unit before introduction of the gas/air mixture into the intake manifold of the engine. Further, in providing such a combination pressure regulator and metering of the gas phase into the air flow in the desired ratio, such single should insure that only gas phase of the fuel is introduced with the ambient air to provide the desired gas/air mixture even though some liquid phase may enter the unit. That is, even if liquid phase enters the unit, the unit must provide that only gas phase is ultimately mixed with the ambient air to provide the desired gas/air mixture for the engine and liquid phase does not enter the engine.

Accordingly, there has long been a need for a carburetor for use in a gas powered internal combustion engine that incorporates both the pressure regulation of the gas as well as the metering of the pressure regulated gas into the air flow to provide the desired gas/air ratio mixture for introduction into the intake manifold of the internal combustion engine.

Accordingly, it is an object of the present invention to provide a combination pressure regulator and carburetor for use in a gas powered internal combustion engine.

It is another object of the present invention to provide a combination pressure regulator and carburetor for use in a gas powered internal combustion engine that minimizes or eliminates any flow of liquid phase of the fuel into the intake manifold of the engine.

It is yet another object of the present invention provide a combination pressure regulator and carburetor for use in a gas powered internal combustion engine wherein the carburetor is positioned in relationship to the internal combustion engine to receive heat therefrom so as to convert any liquid introduced therein into the gas phase.

It is still another object of the present invention to provide a combination pressure regulator and carburetor for use in a gas powered internal combustion engine in which the gas phase of the liquified petroleum gas is metered into the air flow in the desired amount to provide a gas/air mixture corresponding to the operating condition of the internal combustion engine.

It is still another object of the present invention provide a combination pressure regulator and carburetor for use in a gas powered internal combustion engine which may be mounted on the intake manifold or in close proximity thereto so as to absorb heat therefrom.

SUMMARY OF THE INVENTION

The above and other objects of the present invention are achieved, in a preferred embodiment thereof in a carburetor having a body member. The body member has first walls defining a first stage pressure regulating chamber. The first stage pressure regulating chamber may have, in one preferred embodiment of the present invention useful for operation of, for example, a lawn mower, a volume of about 1.6 cubic inches and the first walls may have an area on the order of 11.1 square inches. The first stage pressure regulating chamber has first stage gas inlet port walls defining a first stage gas inlet port into the first stage pressure regulating chamber. The first stage gas inlet port is adapted to be connected to a liquified petroleum gas container which may contain, for example, propane. The liquified petroleum gas container has both the liquid phase and the gas phase of the liquified petroleum gas therein. The gas phase of the liquified petroleum gas is desired for use as the fuel in a gas/fuel mixture for powering an internal combustion engine. The pressure of the gas phase or liquid phase in the liquified petroleum gas container may be on the order of 150 pounds per square inch. The first stage gas inlet port allows the flow of the gas phase or the liquid phase from the liquified petroleum gas container into the first stage pressure regulating chamber. According to the principles of the present invention, the first stage pressure regulating chamber has a comparatively large volume and a comparatively large surface area which aids in ensuring the conversion of any liquid phase of the liquified petroleum gas being converted into the gas phase of the liquified petroleum gas. In a preferred embodiment of the present invention which may be utilized, for example, on a lawn mower, the first stage volume may be on the order of 1.6 cubic inches and the surface area of the first walls of the first stage may be on the order of 8.7 cubic inches.

A first stage diaphragm for regulating gas pressure in the first stage pressure regulating chamber is sealingly mounted in the first stage pressure regulating chamber and is mounted for diaphragm movement towards and away from said first stage gas inlet port. A first stage metering lever pivotally mounted in said first stage pressure regulating chamber and has a first end for movement towards and away from the first stage gas inlet port and a second end spaced from the first end and connected to the first stage diaphragm. A first stage pivot pin is provided in the first stage pressure regulating chamber and the first stage metering lever is pivotally mounted on the first stage pivot pin at a location thereon that is intermediate the first end and the second end thereof. The first end of the first stage metering lever is aligned with the first stage gas inlet port.

For movement of the diaphragm towards the first stage gas inlet port the first end of the first stage metering lever is moved away from the first stage gas inlet port to allow the flow of the gas into the first stage pressure regulating chamber. For movement of the diaphragm away from the first stage gas inlet port, the first end of the first stage metering lever is moved into sealing relationship with the first stage gas inlet port to prevent the flow of gas into the first stage pressure regulating chamber. The first stage pressure regulating chamber diaphragm has an inner surface facing the first stage pressure regulating chamber and an outer surface opposite thereto.

A first stage diaphragm cap is mounted on the body member to cover the first stage diaphragm. A pressure plate is mounted on the first stage diaphragm on the opposite side thereof from the side of the first stage diaphragm facing the first stage pressure regulating chamber. A resilient means such as a first stage coil spring has a first end in contact with the pressure plate and a second end in regions adjacent the first stage diaphragm cap.

A screw member has a first end threadingly mounted in the first stage diaphragm cap and the first end of the screw member is accessible from regions external the body member and the second end of the first stage coil spring bears against the diaphragm pressure plate. The first stage coil spring biases the first stage diaphragm towards the first stage gas inlet port. The first end of the screw member projects to regions external the body member and a control knob is mounted on the first end of the screw member to rotate the screw member and thereby move the first stage diaphragm towards or away from the first stage gas inlet port. When the control knob is rotated in a first direction the first stage diaphragm is moved away from the direction of the first stage gas inlet port thereby causing the first end of the first stage metering lever to block the first stage gas inlet port and prevent the flow of gas into the first stage pressure regulating chamber. When the control knob is rotated in the opposite directions the first stage diaphragm is moved away from the first stage gas inlet port the first end of the first stage metering lever is moved away from the first stage gas inlet port to allow the flow of gas through the first stage gas inlet port and into the first stage pressure regulating chamber.

As the gas phase, gas phase and liquid phase mixture or liquid phase flows into the first stage pressure regulating chamber any liquid phase introduced into the first stage pressure regulating chamber is converted in the first stage pressure regulating chamber of the carburetor to the gas phase. The pressure of the gas on the first stage diaphragm tends to move the diaphragm away from the first stage gas inlet port. The amount of movement of the first stage diaphragm under the pressure of the gas in the first stage pressure regulating chamber that is sufficient to cause the first end of the first stage metering lever to block the first stage gas inlet port is controlled by the biasing force exerted on the diaphragm by the first stage coil spring. The pressure of the gas in the first stage pressure regulating chamber which causes the movement of the first end of the first stage metering lever to block the first stage gas inlet port is less than the gas pressure of the gas in the liquified petroleum gas storage bottle. The gas pressure in the first stage pressure regulating chamber during operation of the internal combustion engine may be in the range of 10.0 to 50.0 pounds per square inch. The first stage pressure regulating chamber has a volume that, for some applications, may, as noted above, be on the order of 1.6 cubic inches though greater or smaller volumes may be provided for particular applications.

There are second walls in the body member defining a second stage pressure regulating chamber. The second stage pressure regulating chamber has a second stage gas inlet port providing a gas flow passage into said second stage pressure regulating chamber. Gas flow passage walls are provided between the first stage gas outlet port and the second stage gas inlet port to allow the flow of gas from the first stage pressure regulating chamber into the second stage pressure regulating chamber. A second stage diaphragm is sealingly mounted in the second stage pressure regulating chamber for regulating gas pressure in said second stage pressure regulating chamber and is mounted for movement towards and away from said second stage gas inlet port.

A second stage metering lever is pivotally mounted in the second stage pressure regulating chamber and is connected to the second stage pressure regulating chamber diaphragm in manner similar to the mounting of the first stage metering lever and has a first end for movement towards and away from the second stage gas inlet port and a second end spaced from the first end and a pivot pin connection pivotally engaging a second stage pressure regulating chamber pivot pin for providing pivotal mounting thereof intermediate the first end and the second end. Movement of the second end of the second stage metering lever is selectively moved into and out of blocking relationship to the second stage gas inlet port for corresponding movement of the second stage diaphragm away from and towards the second stage gas inlet port to regulate the flow of gas into the second stage pressure regulating chamber to provide a gas pressure in the second stage pressure regulating chamber at a gas pressure lower than the gas pressure in the first stage pressure regulating chamber. The regulated pressure of the gas in the second stage pressure regulating chamber may be on the order of 0.5 pounds per square inch.

For a carburetor having a first stage pressure regulating chamber with the above set forth dimensions, the second stage pressure regulating chamber may have a volume of 0.4 cubic inches and may have a surface area on the order of 7.5 square inches.

The second stage pressure regulating chamber diaphragm has an inner surface facing the second stage pressure regulating chamber and an outer surface opposite thereto. A second stage pressure regulating chamber diaphragm cap is mounted on the carburetor body member over the second stage pressure regulating chamber diaphragm. A second stage pressure plate is attached to the outside face of the second stage pressure regulating chamber diaphragm A second stage pressure regulating chamber resilient means such as a coil spring is mounted between an face of the second stage pressure regulating chamber diaphragm opposite the face thereof facing the second stage pressure regulating chamber and the second stage pressure regulating chamber diaphragm cap for biasing the second stage pressure regulating chamber diaphragm towards the second stage gas inlet port for selectively blocking the second stage pressure regulating chamber gas inlet port to prevent the flow of gas into the second stage pressure regulating chamber. For the condition of the gas pressure in the second stage pressure regulating chamber greater than a predetermined value, the second stage pressure regulating chamber diaphragm is moved away from the second stage pressure regulating chamber gas inlet port and the second end of the second stage pressure regulating chamber metering lever blocks the second stage gas inlet port to prevent the flow of gas into the second stage pressure regulating chamber In general, for most operating conditions of the internal combustion engine all of the fuel flowing from the second stage regulating chamber will be in the gas phase and not the liquid phase.

The body member has third walls defining a metering chamber. The metering chamber has a metering chamber gas inlet port providing a gas flow passage into the metering chamber for accepting a gas flow from said second stage pressure regulating chamber gas outlet port. The metering chamber has a metering chamber gas outlet port for allowing the flow of gas from the metering chamber. A metering chamber diaphragm is sealingly mounted at the metering chamber for regulating the gas flow in the metering chamber and is mounted for movement towards and away from the metering chamber gas inlet port. A metering chamber gas flow lever is pivotally mounted in the metering chamber and has a first end for movement towards and away from the metering chamber gas inlet port and a second end spaced from said first end. The second end of the metering chamber gas flow lever is operatively in contact with the metering chamber diaphragm. A pivot pin is provided in the metering chamber and the metering chamber gas flow lever has a pivotal connection to the pivot pin at a point intermediate the first end and the second end thereof.

A metering spring is provided having a first end bearing against the second end of the metering chamber gas flow lever and as second end bearing against the third walls of the body member to urge the first end of the metering chamber gas flow lever into contact with the metering chamber diaphragm. Movement of the metering chamber diaphragm towards the metering chamber gas inlet port moves the first end of the metering chamber gas flow lever away from the metering chamber gas inlet port and movement of the metering chamber diaphragm away from the metering chamber gas inlet port moves the first end of the metering chamber gas flow lever towards the metering chamber gas inlet port.

A needle member is operatively connected to the second end of the metering chamber gas flow lever and moves therewith. The gas pressure in the metering chamber may be in the range of atmospheric to a small vacuum pressure depending on the speed and load of the internal combustion engine to which the carburetor is attached. For the condition of the gas pressure in the metering chamber greater than a preselected value the needle member is moved into the metering chamber gas inlet port to block the flow of gas into the metering The gas pressure in the metering chamber is less than the gas pressure in the second stage pressure regulating chamber.

A metering chamber diaphragm cap is mounted on the body member and bears against the outside face of the metering chamber diaphragm. The metering chamber has a third gas volume less than second gas volume of the second stage pressure regulating chamber. For the application wherein the second stage pressure regulating chamber has the above specified volume of about 1.0 cubic inches, the metering chamber may have a volume on the order of 0.4 cubic inches.

The body member has fourth walls defining a throttle bore. The throttle bore has an ambient air inlet port for allowing the flow of ambient air from regions external the body member into the throttle bore. The throttle bore also has an outlet port which may be connected to the inlet manifold of the internal combustion engine to be powered by the liquified petroleum gas.

The body member has fifth walls defining a gas flow passage providing communication between the gas outlet port of the metering chamber and the throttle bore to allow the flow of gas from metering chamber into the throttle bore for mixing with the ambient air to provide an gas/air mixture having the desired ratio of liquified petroleum gas to ambient air required to power the internal combustion engine at a flow rate required for the particular operating condition of the internal combustion engine between, for example, idle to full throttle thereof. For a carburetor having the gas volumes specified above for the first stage pressure regulating chamber, the second stage pressure regulating chamber, and the metering chamber it has been found that the gas flow through the carburetor at idle is on the order of 18 cubic inches per minute and the gas flow through the carburetor at full throttle is on the order of 152 cubic inches per minute.

The carburetor has sixth walls in said body member defining a gas/air mixture outlet port for allowing the flow of the gas/air mixture to regions external said body member for connection into an inlet manifold of the internal combustion engine.

The carburetor has seventh walls in said body member and the seventh walls define a throttle control chamber providing communication with the throttle bore. A throttle slide is movably mounted in the throttle control chamber for reciprocating motion therein. A throttle needle is connected to the throttle slide for movement therewith. The throttle needle has a needle end for selective movement into and out of the gas inlet port of the throttle bore for controlling the flow of gas into said throttle bore from said metering chamber from full flow to partially blocking the flow of gas into to the throttle bore for the condition of the throttle needle partially blocking the gas inlet port of the throttle bore. A throttle cable or linkage is operatively connected to the throttle slide for moving the throttle slide in the throttle control chamber. A remote end of the throttle cable extends through a throttle cap to regions external the body member and the remote end of the throttle cable may be connected to the throttle mechanism of the internal combustion engine.

A throttle slide spring is positioned in the throttle cap for biasing the throttle slide toward the position wherein the throttle needle may project into the gas inlet port of the throttle bore to control the flow of gas to either block the flow of gas from the metering chamber gas outlet port partially or not at all depending on how far the needle projects into the throttle bore inlet port of the throttle bore. In some applications it may be desired to provide a limitation on how far the throttle needle projects into the throttle bore gas inlet port. For example, it may be advantageous in use of the internal combustion engine to selectively limit the travel of the throttle needle to a position corresponding to the idle speed of the internal combustion engine. To provide such a limitation, a throttle control pin may be threadingly mounted on the body member and have a first end that may project into the throttle bore so as to limit the movement of the throttle slide to a position where the throttle needle is partially extended into the gas outlet port of the metering chamber at the idle speed of the internal combustion engine.

In preferred embodiments of the present invention, the throttle needle is threadingly attached to the throttle slide so adjustments may be made to provide a desired range of gas/air mixtures for various operating conditions of the engine. In general, the position of the throttle needed relative to the throttle slide is made once at the factory manufacturing the carburetor to adjust the position as necessary because of manufacturing tolerances. The throttle slide and the throttle needle always move together. The engine speed is determined by the position of the throttle slide in the throttle bore which controls the amount of air flowing in the throttle bore and the position of the throttle needle in the metering chamber gas outlet port. For each position of the throttle slide in the throttle bore there is a corresponding position of the throttle needle in the gas flow outlet port of the metering chamber so as to provide the desired gas/fuel ratio for the corresponding engine speed.

In those applications of the present invention utilizing a carburetor having the dimensions above set forth, it has been found that the internal combustion engine may have a power on the order of 3 to 6 horsepower but the dimensions may be appropriately scaled for internal combustion engines having a power of, for example, 0.5 to 20 horsepower.

BRIEF DESCRIPTION OF THE DRAWING

The above and other embodiments of the present invention may be more fully understood from the following detailed description taken together with the accompanying drawing wherein similar reference characters refer to similar elements throughout and in which.

DESCRIPTION OF THE PREFERRED EMBODIMENTS

Figure 1:
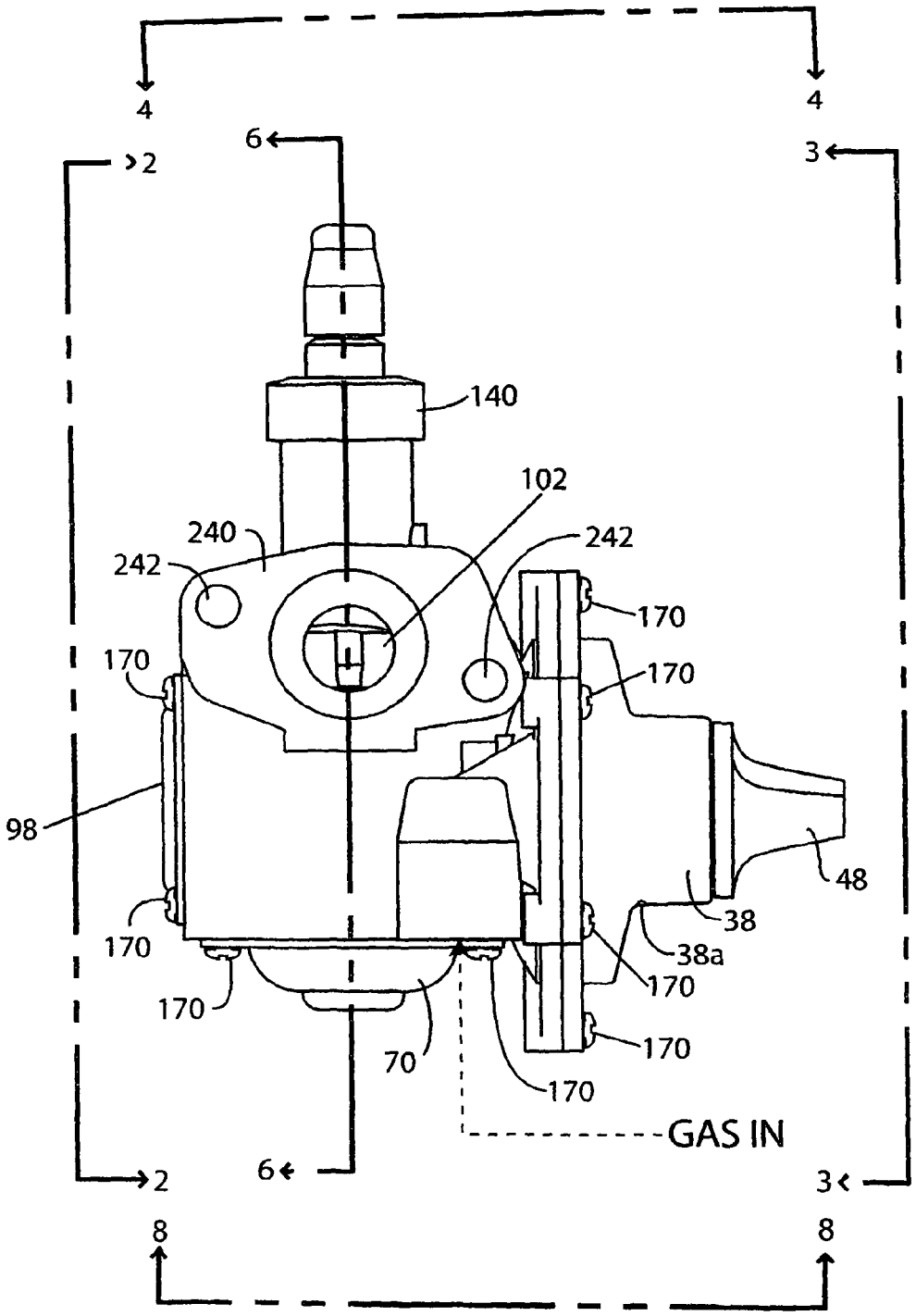
FIG. 1 is a front view of the carburetor according to the principles of the present invention.
Figure 2:
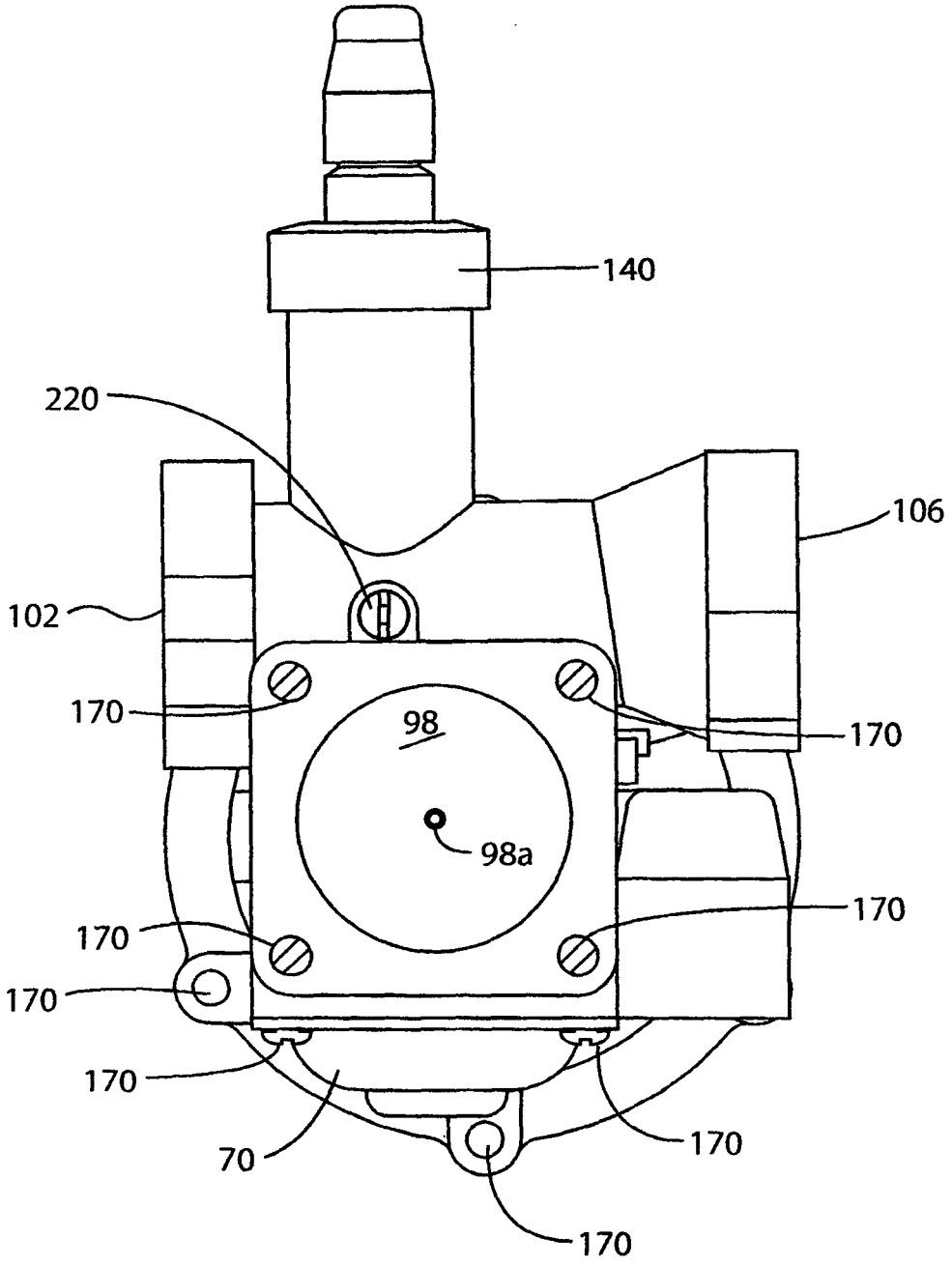
FIG. 2 is a view of the carburetor shown in FIG. 1 along the view line 2-2 of FIG. 1.
Figure 3:
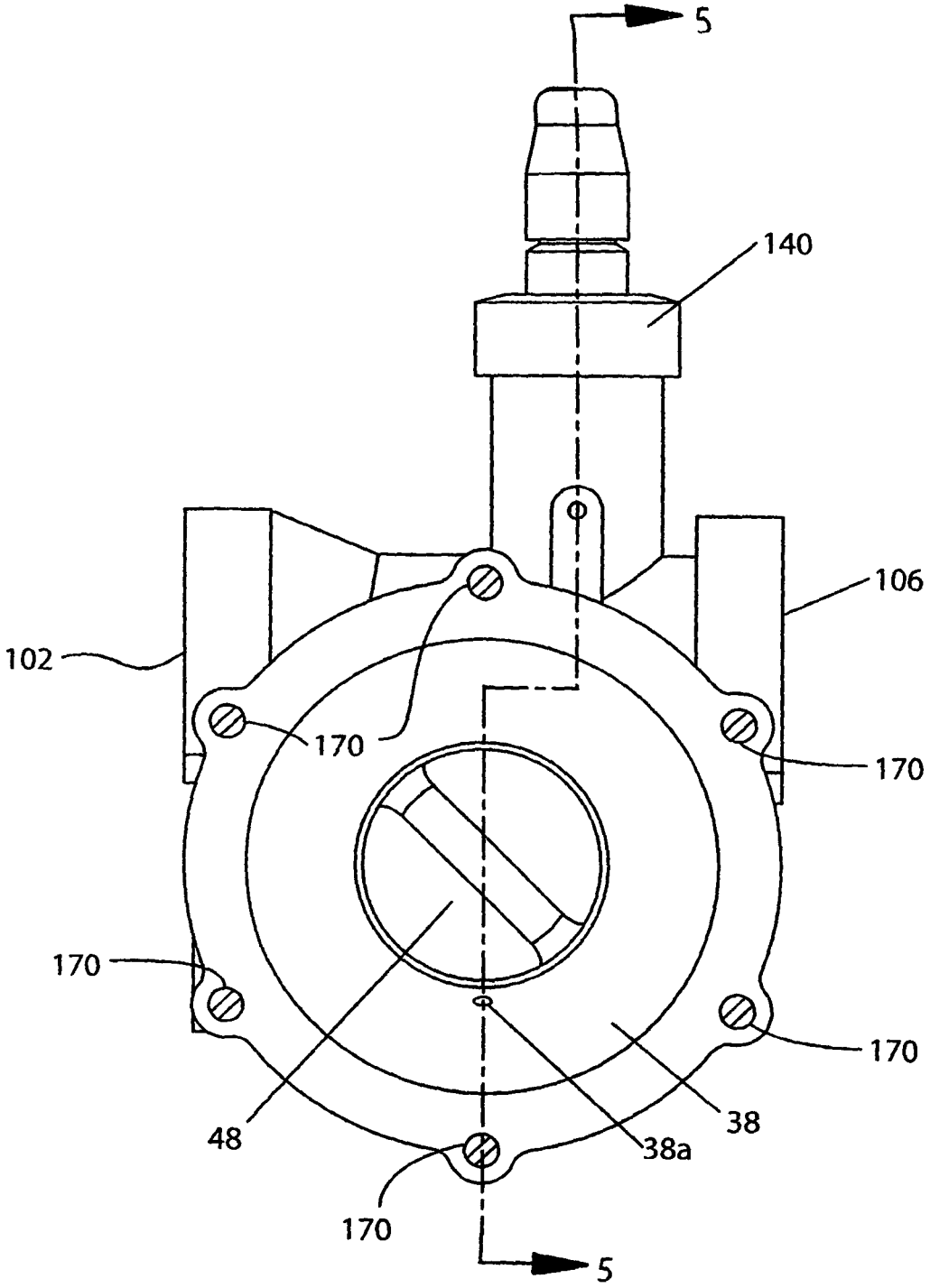
FIG. 3 is a view of the carburetor shown in FIG. 1 along the view line 3-3 of FIG. 1.
Figure 4:
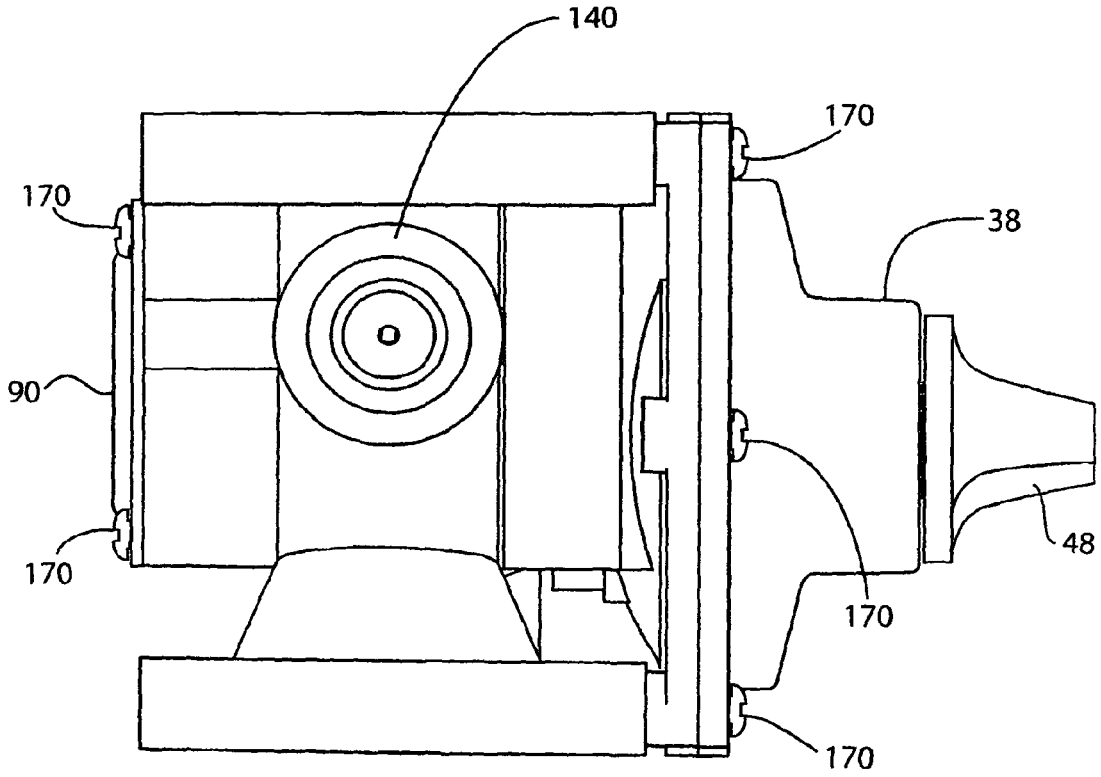
FIG. 4 is a view of the carburetor shown in FIG. 1 along the view line 4-4 of FIG. 1.
Figure 5:
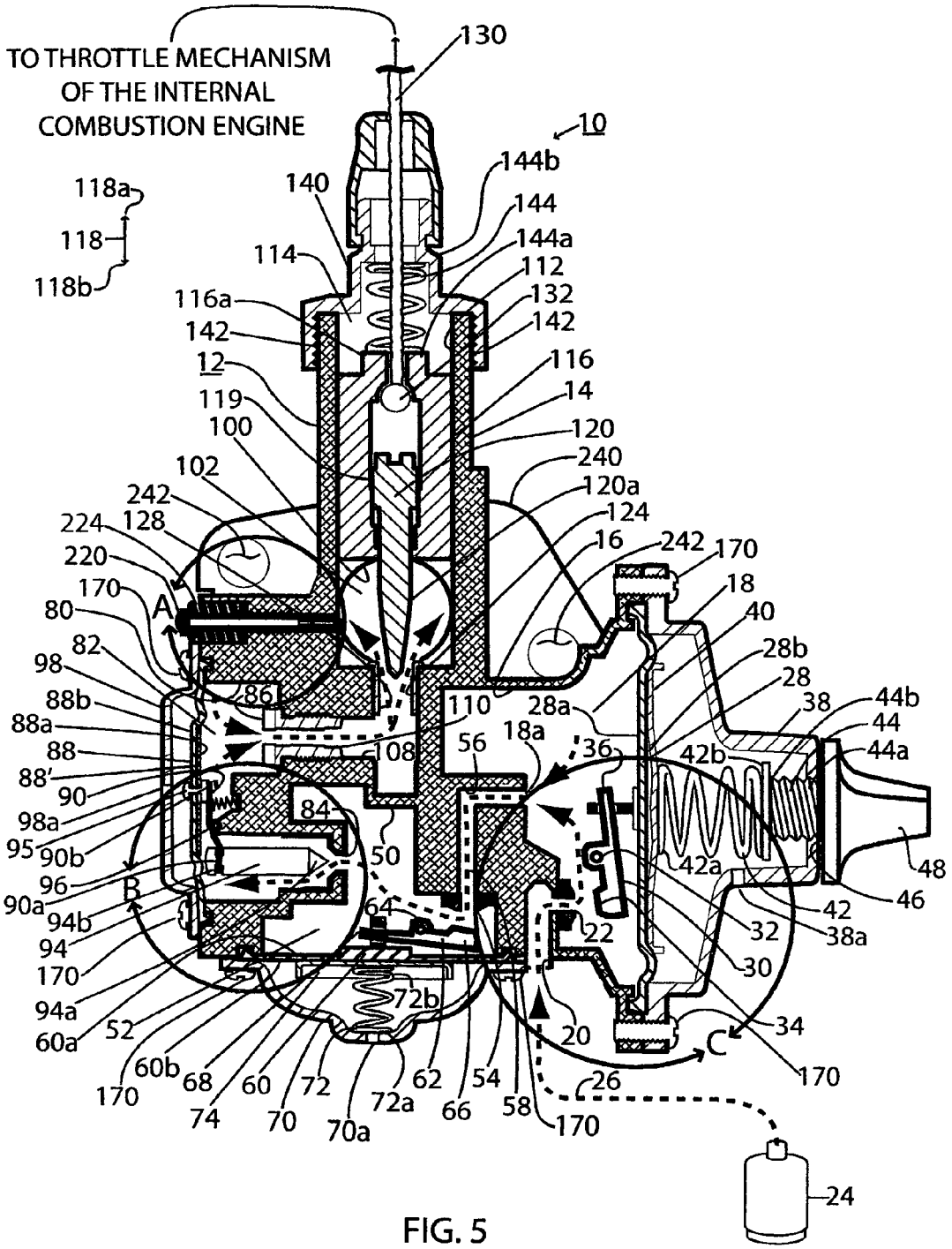
FIG. 5 is a sectional of the carburetor shown in FIG. 1 along the section line 5-5 of FIG. 3.

Referring now to the Figures of the drawing and in particular to the sectional view of FIG. 5, there is shown a preferred embodiment generally designated 10 of the present invention of a carburetor 12 according to the principles of the present invention. The carburetor 12 has a body member 14. The body member 14 has first walls 16 defining a first stage pressure regulating chamber 18. The body member 14 also has first stage gas inlet walls 20 defining a first stage gas inlet port 22. The first stage gas inlet port 22 is adapted to be connected to a liquified petroleum gas container indicated at 24 which contains both the liquid phase and the gas phase of the liquified petroleum gas therein and the liquified petroleum gas may, for example, be propane. The gas phase of the liquified petroleum gas flows out of the liquified petroleum gas container 24 as indicated by the arrow 26 into the first stage gas inlet port 22 and into the first stage pressure regulating chamber 18. Depending upon the operating conditions of the carburetor 12, some of the liquid phase or a mixture of the liquid phase and gas phase of the liquified petroleum gas may also enter the first stage pressure regulating chamber 18. Any liquid phase of the liquified petroleum gas that flows into the first stage pressure regulating chamber is converted by the heat absorbed from the walls 16 of body member 14 of the carburetor 12 to the gas phase. The pressure of the gas phase and/or the liquid phase of the liquified petroleum gas in the liquified petroleum gas container 24 may be on the order of 150 pounds per square inch.

A first stage diaphragm 28 is sealingly mounted on the body member 14 in the first stage pressure regulating chamber 18 and provides diaphragm type movement towards and away from the first stage gas inlet port 22. As utilized herein, "diaphragm movement" refers to that type of movement of a diaphragm wherein the diaphragm is mounted along the edges and the center of the diaphragm moves in response to forces exerted on the diaphragm. A first stage metering lever 30 is pivotally mounted on pivot pin 32 contained in the first stage pressure regulating chamber 18. The first stage metering lever 30 has a first end 34 that moves towards and away from the first stage gas inlet port 22 and a second end 36 spaced from the first end 34 coupled to the first stage diaphragm 28. The pivot pin 32 is intermediate the first end 32 and second end 34 of the first stage metering lever 30 so that movement of the diaphragm 18 towards the first stage gas inlet port 22 in the direction of the arrow 158 (FIG. 13) causes the first end 34 of the first stage metering lever to be retracted from the first stage gas inlet port 22 and movement of the first stage diaphragm 28 away from the first stage gas inlet port 22 in the direction of the arrow 160 (FIG. 13) causes the first end 34 of the first stage metering lever 34 to move towards the first stage inlet port 22 until sufficient such movement of the first stage diaphragm 28 causes the first end 34 of the first stage metering lever 30 to seal the first stage gas inlet port 22 thereby preventing the flow of liquified petroleum gas or liquid phase thereof into the first stage pressure regulating chamber 18. The first stage diaphragm 28 has an inner face 28*a* facing the first stage pressure regulating chamber 18 and an outer face 28*b* opposite thereto.

A first stage diaphragm cap 38 is mounted on the body member 14 by, for example mounting screws 170 (FIG. 13) to cover the first stage diaphragm 18. A pressure plate 40 is mounted on the outer face 28*b* of the first stage diaphragm 18. A resilient means such as coil spring 42 has a first end 42*a* bearing against the pressure plate 40 and a second end 42*b* in regions adjacent the first stage diaphragm pressure cap 38. A screw member 44 is provided that has a first end 44*a* that threadingly engaging the first stage diaphragm cap 38 as indicated at 46. The second end 42*b* of the coil spring 42 bears against the pressure plate 40. The first end 44*a* of screw means 44 can extend to regions external the carburetor 12 and a control knob 48 is coupled to the first end 44*a* of the screw means 44 to rotate the screw means 44. As the screw means 44 is rotated by the control knob 48 in a first direction, the first stage diaphragm 28 is moved towards the first stage gas inlet port 22 and as the screw means 44 is rotated by the control in a second direction opposite the first direction the diaphragm 28 is moved away from the gas inlet port 22.

Figure 12:
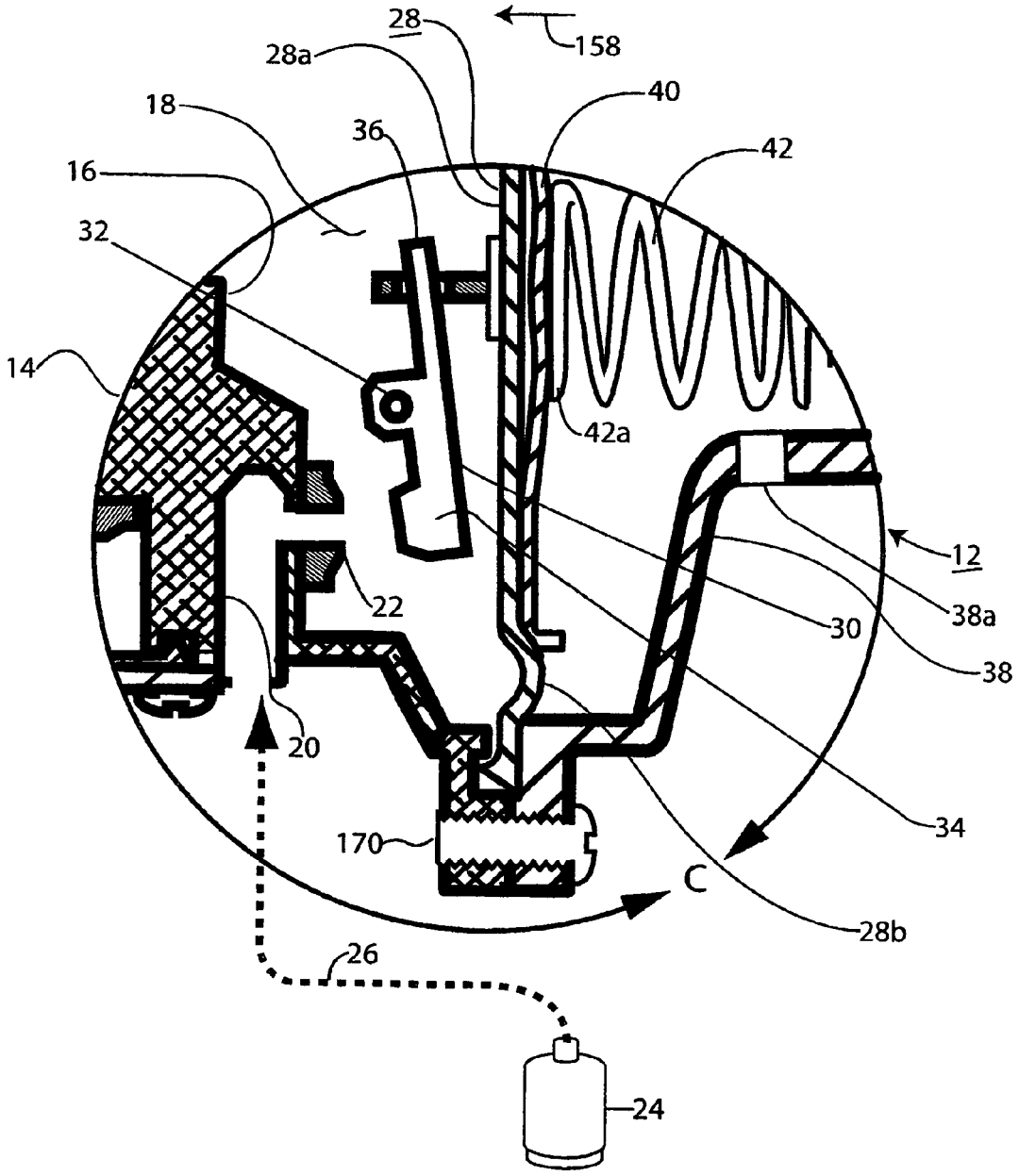
FIG. 12 is a partial sectional view showing indicated on FIG. 5 at detail C showing the attachment of a lever to a diaphragm and the lever allowing gas flow through the gas outlet port useful in the practice of the preset invention.
Figure 13:
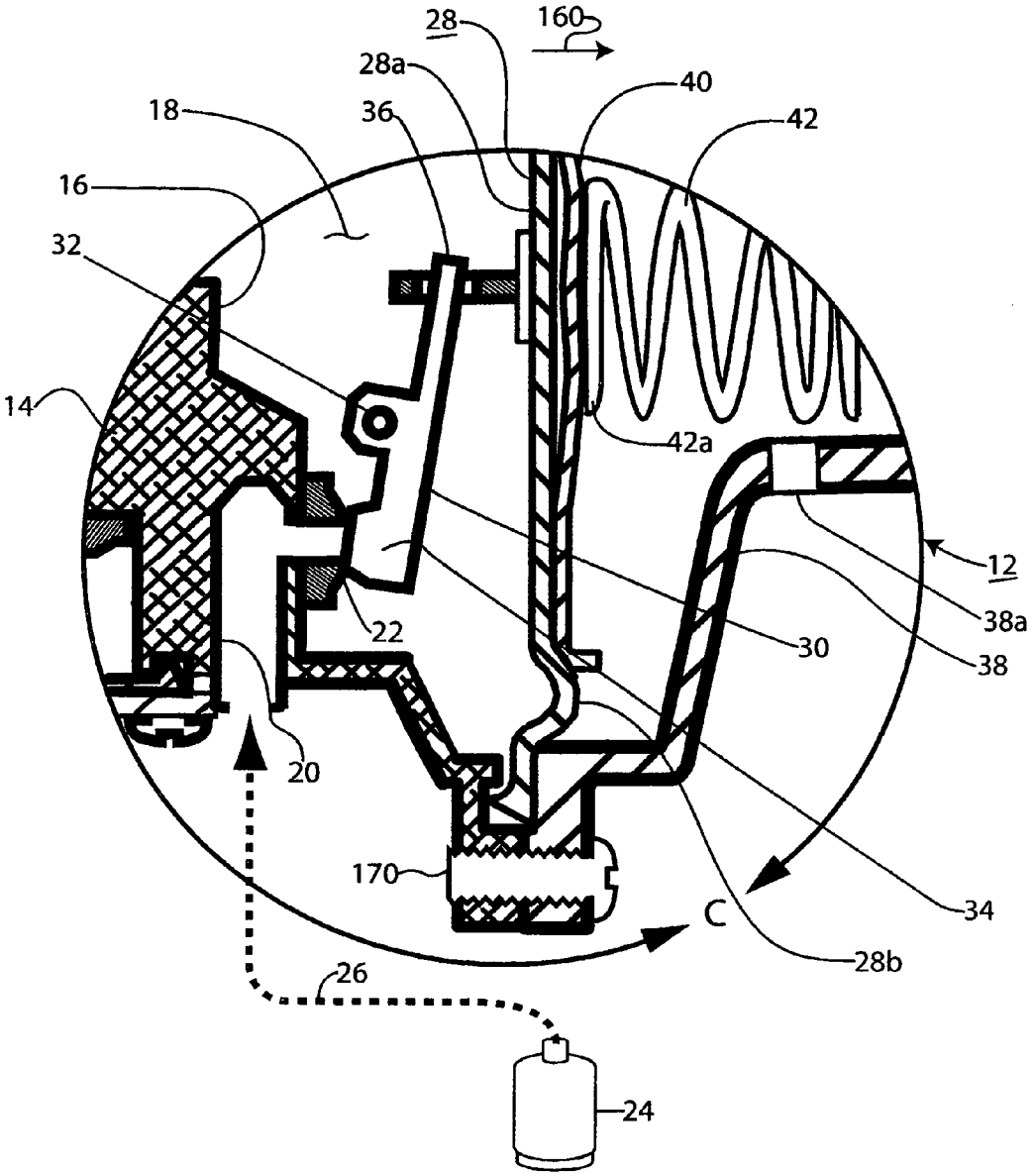
FIG. 13 is a partial sectional view similar to FIG. 12 showing the attachment of a lever to a diaphragm and the lever sealing the gas outlet port useful in the practice of the preset invention; and, FIG. 14 is a block diagram showing the preferred attachment arrangement of the carburetor of the present invention to the inlet manifold of an internal combustion engine.

As shown in greater detail on FIG. 13, as the gas phase, gas phase and liquid phase mixture or liquid phase of the liquified petroleum gas flows into the first stage pressure regulating chamber through the first stage gas inlet port 22, any liquid phase is converted to the gas phase and the pressure of the gas on the first stage diaphragm 28 causes the first stage diaphragm 28 to move in the direction of the arrow 160 away from the first stage gas inlet 22 thereby causing the first end 34 of the first stage metering lever 30 to move towards the first stage gas inlet port 22 until a preselected pressure is reached and at that preselected pressure the first end 34 of the first stage metering lever 30 moves into sealing relationship with the first stage gas inlet port 22 thereby preventing the flow of gas into the first stage pressure regulating chamber. The amount of movement of the first stage diaphragm 28 which will cause the sealing of the first stage gas inlet port 22 is controlled by the amount of pre-loading bias on the first stage diaphragm by the coil spring 42 and the gas pressure in the first stage pressure regulating chamber. As the first stage diaphragm 28 moves toward the first stage gas inlet port 22 in the direction of the arrow 158 (FIG. 12) the first end 34 of the first stage metering lever 30 moves away from the first stage gas inlet port 22 allowing the flow of gas phase and/or liquid phase of the liquified petroleum gas from container 24 to flow into the first stage pressure regulating chamber 18. In some applications of the present invention it may be advantageous to vent the outer face 28*b* of the first stage diaphragm 28. To accomplish such venting, an aperture 28*a* is provided in the diaphragm cap 28 to allow communication of the volume between the outer face 18*a* and the diaphragm cap 28 to be exposed to ambient air at the ambient air pressure.

During operation, the gas pressure of the liquified petroleum gas in the first stage pressure regulating chamber is less than the pressure of the liquified petroleum gas phase in the liquified petroleum gas container 24. The operating pressure of the liquified petroleum gas in the first stage pressure regulating chamber may be in the range of 10.0 to 50.0 pounds per square inch. The first stage pressure regulating chamber 18 also has a first stage gas outlet port 18*a*. In one particular application of the principles of the present invention in the embodiment 10, the volume of the first stage pressure regulating chamber may be on the order of 1.6 cubic inches.

The body member 14 has second walls 50 defining a second stage pressure regulating chamber 52. The second stage pressure regulating chamber 52 has walls 54 defining a second stage gas inlet port 54 which receives gas from the first stage gas outlet port 18*a* in the first stage pressure regulating chamber 18. The body member has walls 56 defining a gas flow passage channel 58 extending from the first stage gas outlet port 18*a* which provides gas flow communication to allow the flow of gas from the first stage pressure regulating chamber 18 into the second stage gas inlet port 54 and into the second stage pressure regulating chamber 52.

A second stage pressure regulating chamber diaphragm 60 is sealingly mounted on the body member 14 for regulating the pressure in the second stage pressure regulating chamber 52 in a manner similar to the mounting of the first stage diaphragm 28 described above. The second stage pressure regulating diaphragm 60 has an inner face 60*a* facing the second stage pressure regulating chamber and an outer face 60*b* opposite thereto. A second stage metering lever 62 is pivotally mounted by pivot pin 64 in the second stage pressure regulating chamber 52 and the second stage metering lever 62 has a first end 66 which is movable into and out of sealing relationship with second stage gas inlet port 54. A second end 68 of the second stage metering lever 62 is attached to the second stage pressure regulating chamber diaphragm as indicated at 70 in the same manner as described above for the first stage metering lever 30. Movement of the first end 66 into and out of sealing relationship with the second stage inlet port 54 is controlled by the corresponding movement of the second stage pressure regulating chamber diaphragm 60 away from and towards, respectively, the second stage gas inlet port 54 in a manner similar to the action of the first stage metering lever 30 described above. The pressure of the gas in the second stage pressure regulating chamber 52 is on the order of 0.5 pounds per square inch. For a carburetor embodiment 10 in which the volume of the first stage pressure regulating chamber 18 is on the order of 1.6 cubic inches as described above, the volume of the second stage pressure regulating chamber 52 is on the order of 1.0 cubic inches.

A second stage pressure regulating chamber diaphragm cap 70 is mounted on the carburetor body 14 by screws 170 over the second stage pressure regulating chamber diaphragm 60. A second stage pressure regulating chamber resilient means such as the coil spring 72 has a first end 72*a* bearing against the second stage pressure regulating chamber diaphragm cap 70 and a second end 72*b* bearing against a pressure plate 74 which is mounted on the outer surface 60*b* of the second stage pressure regulating chamber diaphragm 60. The coil spring 72 urges the second stage pressure regulating chamber diaphragm 60 towards the second stage gas inlet port 58. For the condition of the gas pressure in the second stage pressure regulating chamber 52 above a preset second stage pressure regulating chamber value, the second stage pressure regulating chamber diaphragm 60 is moved away from the second stage gas inlet port 54 causing the first end 66 of the second stage metering lever 62 to block the second stage gas inlet port 54 thereby preventing the further flow of gas into the second stage pressure regulating chamber 52. The pressure of the gas in the second stage pressure regulating chamber 52 is controlled by the pressure of the gas therein and the biasing force exerted on the second stage pressure regulating chamber diaphragm 60 by the coil spring 72. The operation of the second stage pressure regulating chamber diaphragm 60 and second stage metering lever is the same as described above in connection with the first stage pressure regulating chamber diaphragm 28 and first stage metering lever 34 and as illustrated in the detail showing on FIGS. 12 and 13.

The carburetor body 14 has third walls 80 defining a metering chamber 82. The metering chamber 82 has a metering chamber gas inlet port 84 that is in gas flow communication with the second stage pressure regulating chamber 52 to allow the flow of gas from the second stage pressure regulating chamber 52 into the metering chamber 82. The metering chamber 82 also has a gas outlet port 86 to allow the flow of gas from the metering chamber 82. The metering chamber 82 and the structure associated therewith serves the primary purpose of metering the flow of gas phase liquified petroleum gas into the metering chamber 82.

Figure 9:
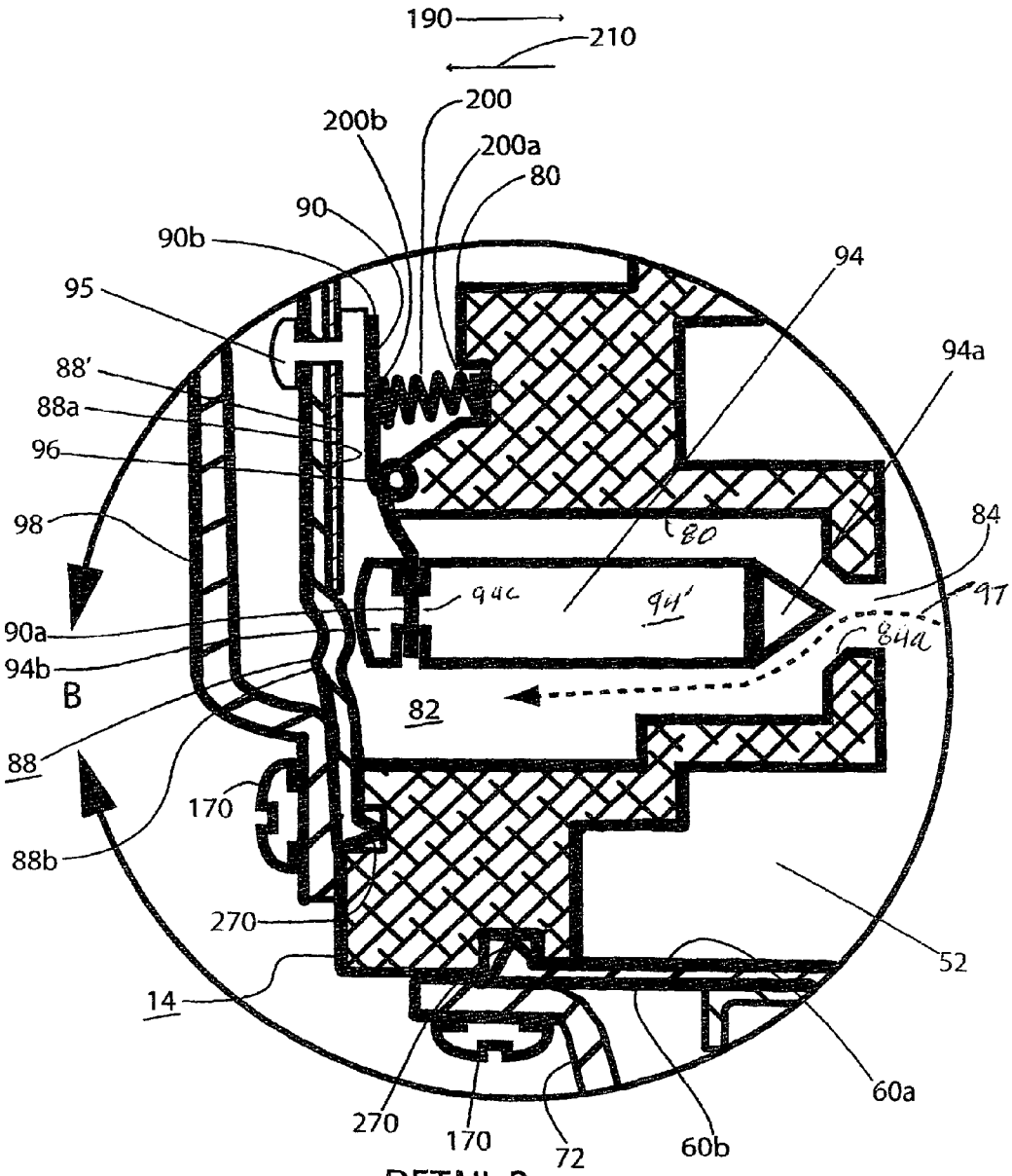
FIG. 9 is a partial a sectional view as indicated on FIG. 5 at detail B of a metering chamber gas flow control arrangement in the open position useful in the practice of the present invention.
Figure 10:
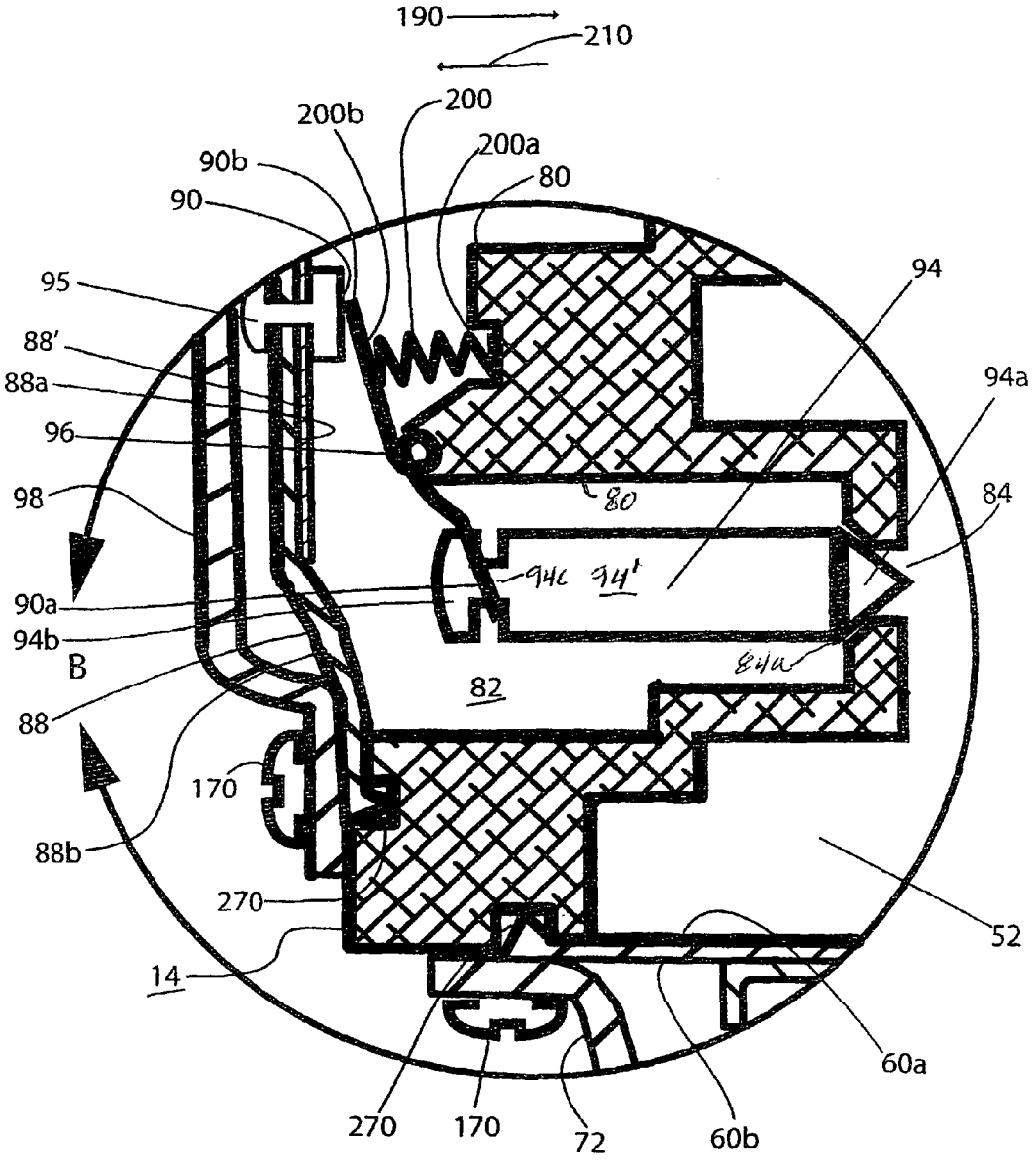
FIG. 10 is a partial a sectional view similar to FIG. 9 of a metering chamber gas flow control in the closed position useful in the practice of the present invention.

A metering chamber diaphragm 88 is sealingly mounted to the carburetor body 14 at the metering chamber 82 for regulating the gas pressure in the metering chamber 82 and is mounted for movement towards and away from the metering chamber gas inlet port 84. As shown on FIG. 5 and in more detail on FIGS. 9 and 10, there is provided a metering chamber gas flow lever 90 having a first end 90*a* operatively connected to a metering needle 94. The metering chamber gas flow lever 90 has a second end 90*b* operatively connected to the metering chamber diaphragm 88. A biasing spring 200 has a first end 200*a* abutting the third walls 80 which define the metering chamber 82. The biasing spring 200 has a second end 200*b* which abuts against the second end 90*b* of the metering lever 90 in regions adjacent to the location of the operative contact between the metering chamber diaphragm 88 and the metering chamber gas flow lever 90. The biasing spring 200 biases the metering chamber diaphragm in the direction of the arrow 210 (FIGS. 9 and 10). The metering needle 94 is mounted in the metering chamber 82 for movement therein in the directions indicated by the arrows 190 and 210 as shown on FIGS. 9 and 10. The metering needle 94 has a body portion 94', first end 94*a* aligned with the metering chamber gas inlet port 84 and a second end 94*b* spaced from the first end 94*a*. The movement of the metering chamber diaphragm 88, moves the metering chamber gas flow lever 90 to thereby move the gas flow metering lever 90 to thereby move the metering needle 94 so that the first end 94*a* thereof is moved into and out of the metering chamber gas inlet port 84 to selectively block and allow the flow of gas into the metering chamber 82 as illustrated in detail on FIGS. 9 and 10. The first end 94*a* of the metering needle 94 is generally conical in shape. The second end 94*b* of the metering needle 94 is a cap like end and is connected to the body 94' of the metering needle 94 by the neck portion 94*c*. The neck portion 94*c* of the metering needle 94 is smaller than the cap like portion second end 94*b* of the metering needle 94. The neck portion 94*c* of the metering needle 94 is also smaller than the body member 94' of the metering needle 94.

The inner edge 84*a* of the gas inlet port 84 is also conical to match the conical shape of the first end 94*a* of the metering needle 94 so that, in the closed position illustrated in FIG. 10, wherein the first end 94*a* of the metering needle 94 is in contact with the inner edge 84*a* of the gas inlet port 84 the gas flow therethrough is blocked The first end 90*a* of the metering chamber gas flow lever 90 is mounted on the metering needle 94 at the neck portion 94*c* so that there is relative movement therebetween as the metering needle 94 is moved between the open and closed positions thereof but the first end 90*a* of the metering chamber gas flow lever 90 is retained in contact with the metering needle 94 on the neck portion 94*c* at all positions thereof in the metering chamber 82 as shown in FIGS. 9 and 10.

The metering chamber diaphragm 88 has an inner face 88*a* facing the metering chamber 82 and an outer face 88*b* opposite thereto. As noted above, the metering needle 94 has the first end 94*a* thereof aligned with the gas inlet port 84 and, with the movement of the metering chamber diaphragm 88, which moves the metering chamber gas flow lever 90 and such movement thereby moves the first end 94*a* of the metering needle 94 into and out of the metering chamber gas inlet port 84 to selectively block the flow of gas into the metering chamber 82 (FIG. 10) and allow the flow of gas into the metering chamber 82 (FIG. 9) as indicated by the arrow 97 on FIG. 9.

The metering chamber diaphragm 88 has an inner face 88*a* facing the metering chamber 82 and an outer face 88*b* opposite thereto.

A pivot pin 96 is mounted in the metering chamber 82 and the metering chamber gas flow lever 90 is mounted on the pivot pin 96 at a point between the first end 90*a* and second end 90*b* thereof for pivotal movement thereon.

A metering chamber diaphragm back up plate 98 is coupled to the carburetor body 14 and bears against the outer face 88*b* of the metering chamber diaphragm 88. The metering chamber diaphragm back up plate 98 has an aperture 98*a* having a preselected area which allows ambient atmospheric air at the ambient air pressure to act upon the outer face 88*b* of the metering chamber diaphragm 88. The outer face 88*b* of the metering chamber diaphragm 88 is exposed to ambient air pressure because of the aperture 98*a* in diaphragm back up plate 98. The biasing spring 200 tends to move the metering chamber diaphragm 88 in the direction of the arrow 210 (FIGS. 9 and 10) thereby tending to move the first end 94*a* of the metering needle 94 into engagement with the metering chamber gas inlet port 84. For the condition of the first end 94*a* of metering needle 94 fully engaging the metering gas chamber inlet port 84 as shown on FIG. 10 the flow of gas into metering chamber 82 is blocked. For the condition of the gas pressure in metering chamber 82 decreasing to a predetermined value lower than the atmospheric air pressure, the force of the atmospheric air pressure on the outer face 88*b* of the metering diaphragm 88 becomes sufficient to overcome the force of the gas pressure on the inner face 88*a* of the metering diaphragm 88 and the force of the biasing spring 200, the metering chamber diaphragm 88 moves in the direction of the arrow 190 (FIGS. 9 and 10) thereby opening metering chamber gas inlet port 84 to allow the flow of gas into metering chamber 88 as shown in FIG. 9.

The a bearing plate 88' may, if desired, be coupled to the inner face 88*a* of the metering chamber diaphragm 88 to provide additional support for the action of the diaphragm 88 against the second end 90*b* of the metering lever 90.

The metering chamber 82 has a volume, for a carburetor having the dimensions as above set forth, in the range of 0.4 cubic inches. The gas pressure in the metering chamber 82 for the carburetor having the dimensions and gas pressures as above descried is on the order of atmospheric to a partial vacuum depending on the speed and load conditions of the internal combustion engine to which the carburetor 14 is operatively connected.

Figure 6:
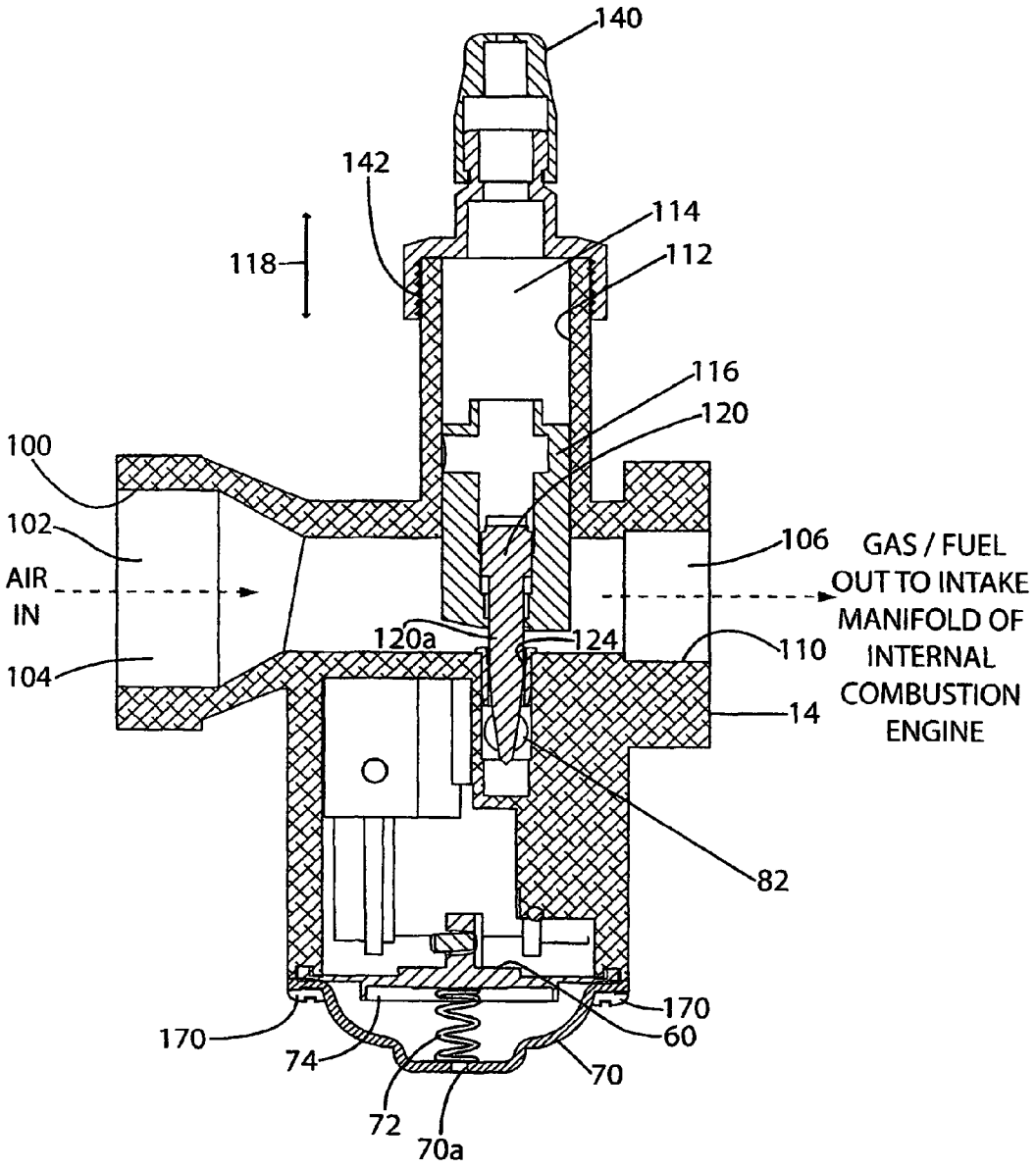
FIG. 6 is a sectional view of the carburetor shown in FIG. 1 along the section line 6-6 of FIG. 1 showing the carburetor at about an idle speed of the internal combustion engine.
Figure 7:
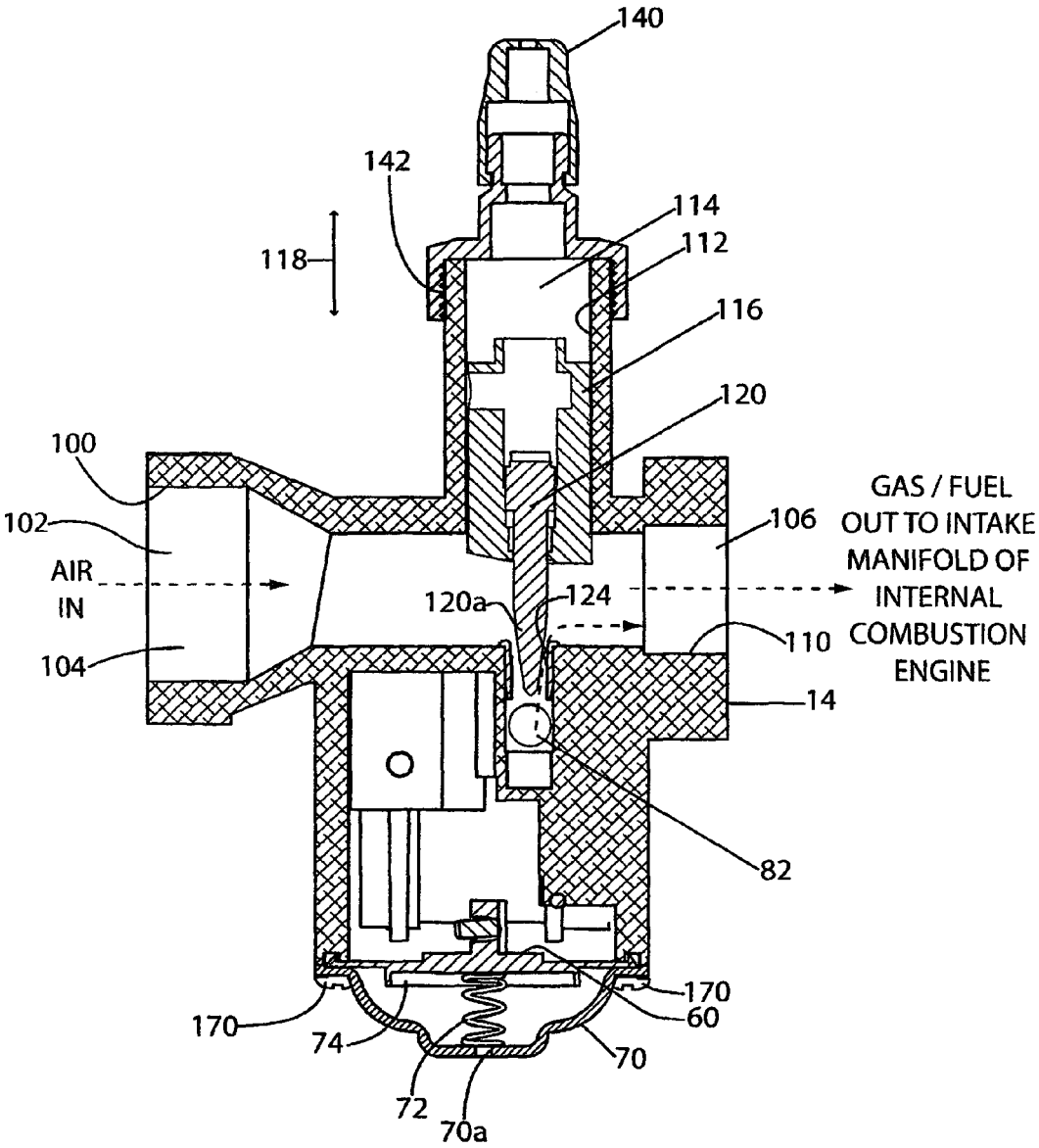
FIG. 7 is a sectional view of the carburetor shown in FIG. 1 similar to FIG. 6 showing the carburetor at about a ¾ speed of the internal combustion engine.
Figure 8:
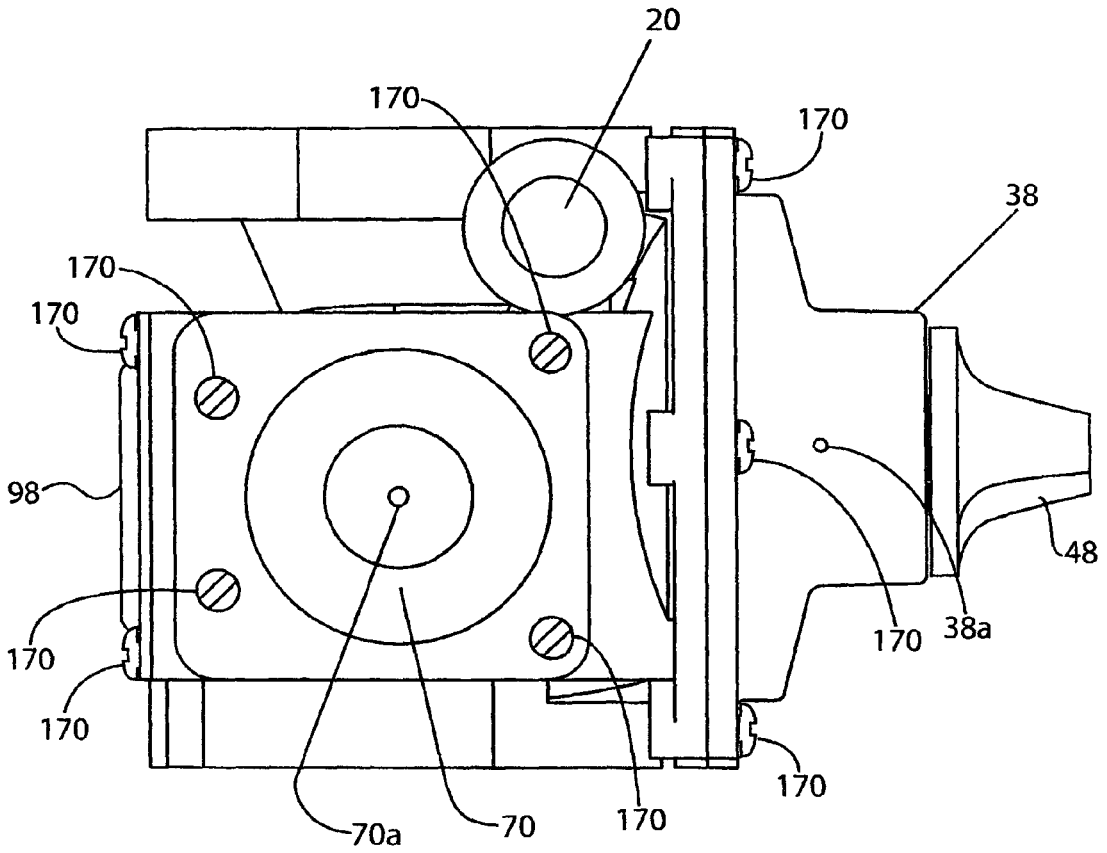
FIG. 8 is a view of the carburetor shown in FIG. 1 along the view line 8-8 of FIG. 1.

As shown on FIGS. 5, 6 and 7, the carburetor body has fourth walls 100 defining a throttle bore 102. As described below in greater detail, the throttle bore 100 has an air inlet port 104 and a gas/air outlet port 106 and the gas outlet port 106 is adapted to be connected to the intake manifold of an internal combustion engine for delivering thereto a gas/fuel mixture having a preselected gas to air ratio for the particular operating conditions of the internal combustion engine.

The carburetor body has fifth walls 108 defining a gas flow passage 110 which provides gas flow communication between the metering chamber 82 and the throttle bore 102 to allow the flow of gas from the metering chamber 82 into the throttle bore 102. The diameter of the throttle bore 102 is smaller than the air inlet port 104 and the gas/air outlet port 106. This creates a venturi when air flow is drawn through the throttle bore 102 by the suction applied by the internal combustion engine. As the flow of air passes into the reduced diameter throttle bore 102, the speed of the airflow increases and the pressure decreases. The now lower than ambient air pressure present in the throttle bore 102 is connected by the metering chamber outlet passage 110 to the metering chamber 82. The greater atmospheric pressure present on the metering chamber diaphragm outer surface 88*a* causes the metering chamber diaphragm 88 to move towards the metering chamber inlet port 84, which in turn causes the metering chamber needle 94 to lift from the metering chamber gas inlet port which allows the flow of liquefied petroleum gas into the metering chamber 82. The flow of gas continues into the metering chamber outlet port 110 and thus into the throttle bore 102. The gas mixes with ambient air in the throttle bore 102 to provide a gas/air mixture with the desired ratio of liquified petroleum gas to air required by the internal combustion engine at a flow rate required by the particular operating conditions of the internal combustion engine. For a carburetor having the dimensions and configurations as above described, it has been found that the gas flow through the carburetor from the gas inlet port 22 to the throttle bore 102 may be on the order of 18 cubic inches per minute at idle to a gas flow rate on the order 152 cubic inches per minute for the internal combustion engine at full throttle.

As shown on FIGS. 6 and 7, there are sixth walls 110 in the throttle inlet port 102 defining the gas/air mixture outlet port 106 for introduction of the gas/air mixture into the inlet manifold of an internal combustion engine to be powered by the liquified petroleum gas.

The carburetor has seventh walls 112 defining a throttle control chamber 114. A throttle slide 116 is mounted for sliding movement in the throttle control chamber 114 in the directions indicated by the double ended arrow 118. A throttle needle 120 is mounted on the throttle slide 116 for reciprocating motion therewith in the directions indicated by the double ended arrow 118. The throttle needle 120 has a needle end 120*a* for selective movement into and out of a gas inlet port 124 to meter the flow of gas into the throttle bore from full flow wherein the first end of the needle 120*a* is retracted from the gas inlet port 124 to a position where the first end 120*a* of the needle 120 partially blocks the aperture in the insert 128 to reduce the flow of gas into the throttle bore 102 at an idle speed of the internal combustion engine. The taper of the needle end 120*a* of the throttle needle 120 is shaped to partially block the aperture in insert 128 at any position of between fully open throttle slide 116 and a fully closed position to provide the metering function of the correct gas/air ratio for the specific internal combustion engine at any engine speed or load. The throttle needle 120 is threadingly attached to the throttle slide 116 as indicated at 119 for movement therewith. By rotating the throttle needle at the threading engagement 119, an adjustment of the gas/air ratio is achieved. A throttle cable 130 is operatively connected to the throttle slide to move the throttle slide in the direction indicated by the upper arrow 118*a* when the contact ball 132 engages the upper end 116*a* of the throttle slide 116. A throttle cap 140 is threadingly connected to the carburetor body 14 as indicated at 142 and a throttle spring 144 is mounted in the throttle cap 140 and has a first end 144*a* bearing against the upper end 116*a* of the throttle slide 116 and a second end 144*b* bearing against the throttle cap 140 to bias the throttle slide 116 in the direction of the second arrow 118*b*.

Figure 11:
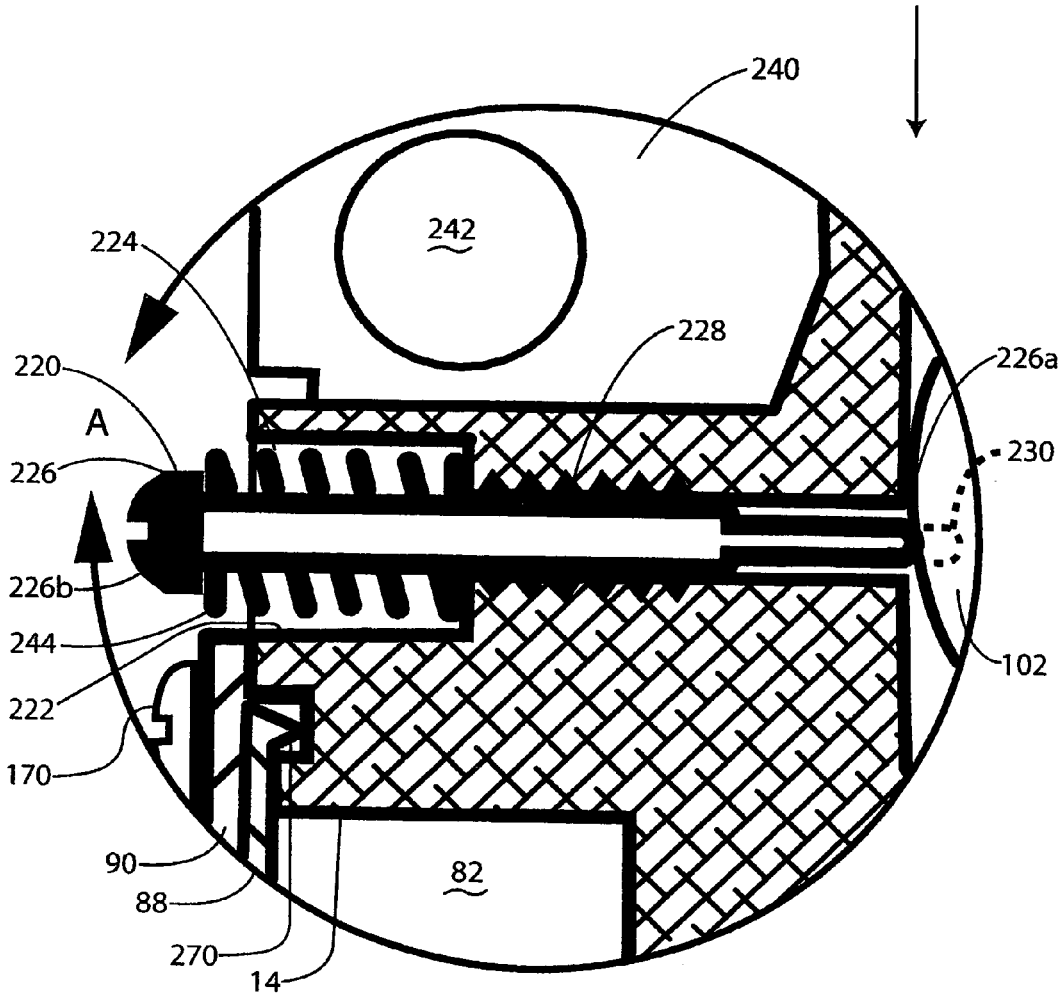
FIG. 11 is a partial sectional view as indicated on FIG. 5 at detail A showing an idle adjustment screw useful in the practice of the present invention.

In some applications of a carburetor according to the principles. of the present invention, it may be desirable to provide a throttle slide movement limitation 220 on the travel of the throttle slide 116 towards the gas inlet port 124 to thereby limit the penetration of the throttle needle 120 into the gas inlet port 124. FIG. 11 illustrates the details of the throttle slide movement limitation 220. As shown thereon, there are walls 222 in the body member 14 in regions adjacent the throttle bore 102 defining a limitation chamber 224. A control needle 226 threadingly engages the body member 14 as indicated at 228. The control needle 226 has a first end 226*a* that may be moved into the throttle bore 102 as indicated by the dotted line showing at 230 by rotating the adjustment end 226*b* of the control needle 226. For the first end 226*a* of the control needle 226 projecting onto the throttle bore as shown by the dotted line, the throttle slide 116 engages the first end 226*a* and thus downward movement of the throttle slide 116 is stopped at a predetermined position corresponding to the desired minimum opening of the gas inlet port 128. A control needle spring 244 is positioned in the limitation chamber 224 and abuts the body member 14 and the second end 226*b* of the control needle 226 to bias the control needle 226 outwardly.

The carburetor 12 may be provided with flanges 240 having apertures 242 therethrough which may be utilized for attachment of the carburetor to the internal combustion engine as desired.

Figure 14:
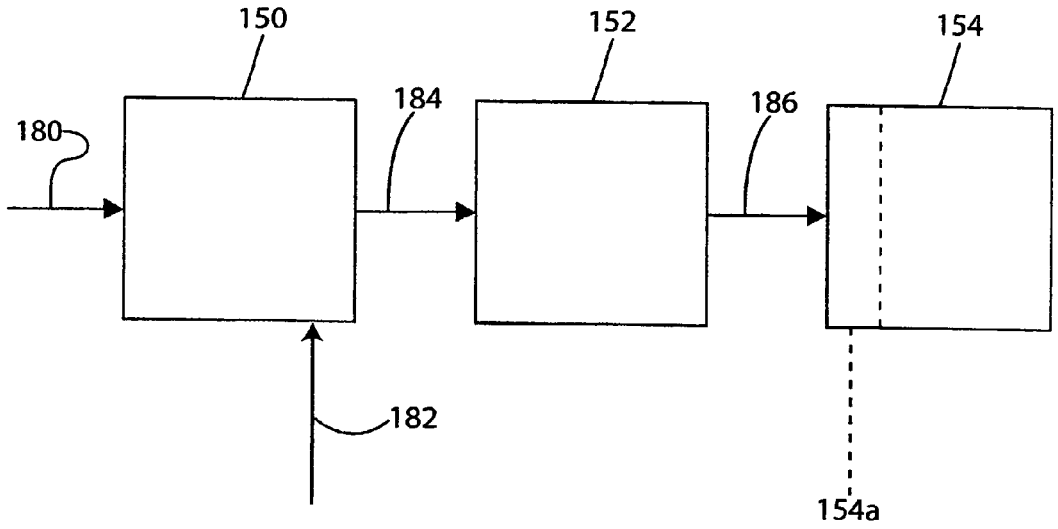

FIG. 14 illustrates a block diagram showing the preferred mounting relationship between the carburetor, an intake manifold and an internal combustion engine. As shown on FIG. 14, a carburetor 150, which may be the same as carburetor 12 described above, receives ambient air indicated by the arrow 180 and gas phase/liquid phase liquified petroleum gas such as propane, as indicated by the arrow 182. The carburetor 150 converts any liquid phase liquified petroleum gas entering the carburetor 150 into the gas phase thereof and mixes the gas phase with the ambient air in a preselected gas to air ratio and provides the gas/air mixture at the outlet thereof, as indicated by the arrow 184, as described above for the operation of carburetor 12. The carburetor 150 is mounted on or in close proximity to an intake manifold 152 of an internal combustion engine 154 so as to be in heat receiving relationship thereto. That is, in the preferred embodiments of the present invention the carburetor such as the carburetor 150, which may be the same as carburetor 12, shown in the block diagram of FIG. 14, is in heat receiving relationship to the internal combustion engine 154 so that the carburetor 150 receives heat by any or all of the heat transfer modes of radiation, conduction and convection from the engine and/or and structural parts thereof and/or and accessories thereof. The heat received by the carburetor 150 supplies the necessary energy to convert any liquid phase of the liquified petroleum gas which enters the first stage pressure regulator chamber of the carburetor into the gas phase. The intake manifold 152 directs the gas/fuel mixture as shown by the arrow 186 to the cylinders 154*a* of the internal combustion engine 154 which may be connected to any desired device (not shown) to provide the operation thereof.

As noted above, the diaphragms 40, 60 and 88 are sealingly mounted on the body member 14. FIGS. 9, 10 and 11 illustrate a preferred sealing arrangement. The diaphragms are provided with a knife edge that bears against the body member 14 and the force of the back up plates bearing against the diaphragms provides the desired sealing engagement. However, other sealing arrangements may be utilized as desired in particular applications.

Although specific embodiments of the present invention have been described above with reference to the various Figures of the drawing, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims. While the particular embodiments and applications of the present invention have been above described and illustrated, the present invention is not limited to the precise construction and arrangements disclosed. Those persons knowledgeable in the art may also conceive of certain modifications, changes and variations in the precise details of the embodiments disclosed above for adaptation of the principles of the present invention to various applications to suit particular circumstances or products to be formed. The invention is therefore not intended to be limited to the preferred embodiments depicted, but only by the scope of the appended claims and the reasonably equivalent apparatus and methods as described herein.

The invention claimed is:

1. A carburetor for a gas powered engine comprising, in combination:

a body member;

first walls in said body member defining a first stage pressure regulating chamber in said body member having a first stage gas inlet port providing gas flow passage into said first stage pressure regulating chamber for accepting a gas flow at a first gas pressure, a first stage gas outlet port, a first stage diaphragm for regulating gas pressure in said first stage pressure regulating chamber; a first stage metering lever in said first stage pressure regulating chamber pivotally mounted on said first stage diaphragm to provide movement of said first stage metering lever selectively into and out of blocking relationship to said first stage gas inlet port for corresponding movement of said first stage diaphragm away from and towards said first stage gas inlet port to provide a gas pressure in said first stage pressure regulating chamber at a second gas pressure lower than said first gas pressure, and said first stage pressure regulating chamber having a first gas volume;

second walls in said body member defining a second stage pressure regulating chamber in said body member having a second stage gas inlet port providing gas flow passage into said second stage pressure regulating chamber for accepting a gas flow at said second gas pressure, a second stage gas outlet port, a second stage diaphragm for regulating gas pressure in said second stage pressure regulating chamber and mounted for movement towards and away from said second stage gas inlet port, a second stage metering lever pivotally mounted in said second stage pressure regulating chamber connected to said second stage diaphragm to provide movement of said second stage metering lever selectively into and out of blocking relationship to said second stage gas inlet port to provide a gas pressure in said second stage pressure regulating chamber at a third gas pressure lower than said first gas pressure and said second gas pressure, and said second stage pressure regulating chamber having a second gas volume less than said first gas volume of said first stage pressure regulating chamber;

first gas flow passage walls in said body member defining a first gas flow passage providing communication between said first stage pressure regulating chamber and said second stage pressure regulating chamber for allowing the flow of gas from said first stage pressure regulating chamber into said second stage pressure regulating chamber;

third walls in said body member defining a metering chamber in said body member having a metering chamber gas inlet port providing a gas flow passage into said metering chamber for accepting gas flow at said second gas pressure, a metering chamber gas outlet port, a metering chamber diaphragm for regulating gas pressure in said metering chamber and mounted for movement towards and away from said metering chamber gas inlet port, a metering chamber gas flow lever in said metering chamber and operatively connected to said metering chamber diaphragm to provide movement of said metering chamber gas flow lever selectively towards and away from said metering chamber gas inlet port, a metering needle operatively connected to a first end of said metering chamber gas flow lever for movement of said metering needle into and out of said metering chamber gas inlet port for metering the flow of gas into said metering chamber to provide a gas pressure in said metering chamber at a fourth gas pressure lower than said first gas pressure, said second gas pressure and said third gas pressure, and said metering chamber having a third gas volume less than said second gas volume, and wherein said metering needle has a body portion, a generally conical first end for selective engagement and disengagement with said gas flow inlet port, a body portion and a second end and said second end is spaced from said body portion by a neck portion, said first end of said metering chamber gas flow lever movably connected to said neck portion of said metering needle, said neck portion smaller than said body portion of said metering needle and smaller than said second end of said metering needle;

fourth walls in said body member defining a throttle bore having an ambient air inlet port for allowing the flow of ambient air from regions external said body member into said throttle bore;

fifth walls in said body member defining a gas flow passage providing communication between said metering chamber and said throttle bore to allow the flow of gas from said metering chamber into said throttle bore for mixing with said ambient air to provide an air/gas mixture;

sixth walls in said body member defining an air/gas mixture outlet port for allowing the flow of the air/gas mixture to regions external said body member.

2. The arrangement defined in claim 1 and further comprising:

seventh walls in said body member defining a throttle control chamber providing communication with said throttle bore;

a throttle slide movably mounted in said throttle control chamber for reciprocating motion therein;

a throttle needle connected to said throttle slide having a needle end for selective movement into and out of said gas outlet port of said metering chamber for controlling the flow of gas into said throttle bore;

a throttle cable operatively connected to said throttle slide for moving said throttle slide in said throttle control chamber.

3. The arrangement defined in claim 1 and further comprising:

a first stage pressure regulating chamber diaphragm cap mounted on said body member in regions adjacent said first stage pressure regulating chamber diaphragm;

a first stage diaphragm pressure plate bearing against said first stage diaphragm;

a first stage biasing spring intermediate said first stage diaphragm pressure plate and said first stage diaphragm for biasing said first stage diaphragm towards said first stage pressure regulating chamber gas inlet port;

a first stage screw member having a first end bearing against said first stage biasing spring and a second end threadingly engaging said first stage pressure regulating chamber diaphragm cap;

a control knob external said body member coupled to said first sage screw member external said carburetor body for selectively compressing and relaxing said first stage biasing spring to selectively open and close said first stage gas inlet port.

4. The arrangement defined in claim 1 and further comprising:

a second stage pressure regulating chamber diaphragm cap mounted on said body member in regions adjacent said second stage pressure regulating chamber diaphragm;

a second stage biasing spring intermediate said second stage diaphragm pressure plate and said second stage diaphragm cap for biasing said second stage diaphragm towards said second stage pressure regulating chamber gas inlet port.

5. The arrangement defined in claim 2 and further comprising:

a first stage pressure regulating chamber diaphragm cap mounted on said body member in regions adjacent said first stage pressure regulating chamber diaphragm;

a first stage diaphragm pressure plate bearing against said first stage diaphragm;

a first stage biasing spring intermediate said first stage diaphragm pressure plate and said first stage diaphragm for biasing said first stage diaphragm towards said first stage pressure regulating chamber gas inlet port;

a first stage screw member having a first end bearing against said first stage biasing spring and a second end threadingly engaging said first stage pressure regulating chamber diaphragm cap;

a control knob external said body member coupled to said first sage screw member for selectively compressing and relaxing said first stage biasing spring to selectively open and close said first stage gas inlet port.

6. The arrangement defined in claim 5 and further comprising:

a second stage pressure regulating chamber diaphragm cap mounted on said body member in regions adjacent said second stage pressure regulating chamber diaphragm;

a second stage biasing spring intermediate said second stage diaphragm pressure plate and said second stage diaphragm cap for biasing said second stage diaphragm towards said second stage pressure regulating chamber gas inlet port.

7. The arrangement defined in claim 1 wherein:

said first gas volume of said first stage pressure regulating chamber is on the order of 1.6 times the volume of said second gas volume of said second stage pressure regulating chamber.

8. The arrangement defined in claim 1 wherein:

said second gas volume of said second stage pressure regulating is on the order of 2.5 times the volume of said third gas volume of said metering chamber.

9. The arrangement defined in claim 7 wherein:

said second gas volume of said second stage pressure regulating is on the order of 2.5 times the volume of said third gas volume of said metering chamber.

10. The arrangement defined in claim 2 wherein:

said first gas volume of said first stage pressure regulating chamber is on the order of 1.6 times the volume of said second gas volume of said second stage pressure regulating chamber.

11. The arrangement defined in claim 2 wherein:

said second gas volume of said second stage pressure regulating is on the order of 2.5 times the volume of said third gas volume of said metering chamber.

12. The arrangement defined in claim 11 wherein:

said first gas volume of said first stage pressure regulating chamber is on the order of 1.6 times the volume of said second gas volume of said second stage pressure regulating chamber.

13. The arrangement defined in claim 2 and further comprising:

said first stage pressure regulating chamber diaphragm has an inner surface facing said first stage pressure regulating chamber and an outer surface facing away from first stage pressure regulating chamber;

a first stage pressure regulating chamber diaphragm cap mounted on said body member in regions adjacent said outer surface of said first stage pressure regulating chamber diaphragm;

a first stage diaphragm pressure plate bearing against said outer surface of said first stage diaphragm;

a first stage biasing spring intermediate said first stage diaphragm pressure plate and said first stage diaphragm for biasing said first stage diaphragm towards said first stage pressure regulating chamber gas inlet port;

a first stage screw member having a first end bearing against said first stage biasing spring and a second end threadingly engaging said first stage pressure regulating chamber diaphragm cap;

a control knob external said body member coupled to said first sage screw member for selectively compressing and relaxing said first stage biasing spring to selectively open and close said first stage gas inlet port.

14. The arrangement defined in claim 13 and further comprising:

said second stage pressure regulating chamber diaphragm has an inner surface facing said second stage pressure regulating chamber and an outer surface facing away from said second stage pressure regulating chamber;

a second stage pressure regulating chamber diaphragm cap mounted on said body member in regions adjacent said outer surface of said second stage pressure regulating chamber diaphragm;

a second stage biasing spring intermediate said second stage diaphragm pressure plate and said second stage diaphragm cap for biasing said second stage diaphragm towards said second stage pressure regulating chamber gas inlet port.

15. The arrangement defined in claim 14 and further comprising:

said metering chamber diaphragm has an inner surface facing said metering chamber and an outer surface facing away from said metering chamber;

a metering chamber diaphragm cap mounted on said body member in regions adjacent said metering chamber diaphragm.

16. The arrangement defined in claim 15 and further comprising:

at least one of said first stage pressure regulating chamber diaphragm cap and said second stage pressure regulating chamber diaphragm cap and said metering chamber diaphragm cap has walls defining an aperture therethrough.

17. The arrangement defined in claim 16 and further comprising:

said first stage pressure regulating chamber diaphragm cap has walls defining an aperture therethrough to vent said outer face of said first stage pressure regulating chamber diaphragm to atmospheric pressure.

18. The arrangement defined in claim 15 and further comprising:

second stage pressure regulating chamber diaphragm cap has walls defining an aperture therethrough to vent said outer face of said second stage pressure regulating chamber diaphragm to atmospheric pressure.

19. The arrangement defined in claim 15 and further comprising:

metering chamber diaphragm cap has walls defining an aperture therethrough to vent said outer face of said metering chamber diaphragm to atmospheric pressure.

20. The arrangement defined in claim 15 and further comprising:

each of said first stage pressure regulating chamber diaphragm cap and said second stage pressure regulating chamber diaphragm cap and said metering chamber diaphragm cap has walls defining an aperture therethrough for providing ventilation to atmospheric pressure therethrough.

21. The arrangement defined in claim 15 and further comprising:

a bearing plate mounted on said inner surface of said metering chamber diaphragm.

22. The arrangement defined in claim 21 and further comprising:

a rivet extending through said bearing plate and said metering chamber diaphragm.

23. The arrangement defined in claim 22 and further comprising:

said second end of said metering chamber gas flow lever is in contact with said rivet;

a biasing spring member having a first end engaging said third walls of said body member and a second end engaging said second end of said metering chamber gas flow lever for biasing said second end of said metering chamber gas flow lever into contact with said rivet.

24. A carburetor for a gas powered engine comprising, in combination:

a body member;

first walls in said body member defining a first stage pressure regulating chamber in said body member having a first stage gas inlet port providing a gas flow passage into said first stage pressure regulating chamber, a first stage diaphragm for regulating gas pressure in said first stage pressure regulating chamber in a first preselected gas pressure range, a first stage metering lever movably mounted in said first stage pressure regulating chamber and operatively connected to said first stage diaphragm for selectively opening and closing said first stage gas inlet port in response to movement of said first stage diaphragm, and said first stage pressure regulating chamber having a first gas volume;

second walls in said body member defining a second stage pressure regulating chamber in said body member having a second stage gas inlet port providing a gas flow passage into said second stage pressure regulating chamber for accepting a gas flow from said first stage pressure regulating chamber, a second stage gas outlet port, a second stage diaphragm for regulating gas pressure in said second stage pressure regulating chamber in a second preselected gas pressure range, and a second stage metering lever operatively connected to said second stage diaphragm for selectively opening and closing said second stage gas inlet port to provide to regulate gas pressure in said second stage pressure regulating chamber in a second preselected gas pressure range, and said second stage pressure regulating chamber having a second gas volume less than said first gas volume of said first stage pressure regulating chamber;

first gas flow passage walls in said body member defining a first gas flow passage providing communication between said first stage pressure regulating chamber and said second stage pressure regulating chamber for allowing the flow of gas from said first stage pressure regulating chamber into said second stage pressure regulating chamber;

third walls in said body member defining a metering chamber in said body member having a metering chamber gas inlet port providing a gas flow passage into said metering chamber for accepting a gas flow from said second stage pressure regulating chamber, a metering chamber diaphragm for operatively connected to a metering chamber gas flow lever, a metering needle having a first end, a body portion, a second end and a neck portion connecting said second end to said body portion and said metering chamber gas flow lever movably connected to said neck portion of said metering needle and said gas inlet port having a conical seating surface for selective engagement and disengagement with said conical first end of said metering needle for the movement of said metering chamber gas flow lever towards and away from said gas inlet port of said metering chamber for metering the flow of gas through said metering chamber and said metering chamber having a third gas volume less than said second gas volume;

fourth walls in said body member defining a throttle bore having an ambient air inlet port for allowing the flow of ambient air from regions external said body member into said throttle bore;

fifth walls in said body member defining a gas flow passage providing communication between said metering chamber and said throttle bore to allow the flow of gas from said metering chamber into said throttle bore for mixing with said ambient air to provide an air/gas mixture;

sixth walls in said body member defining an air/gas mixture outlet port for allowing the flow of the air/gas mixture to regions external said body member.

25. The arrangement defined in claim 24 and further comprising:

seventh walls in said body member defining a throttle control chamber providing communication with said throttle bore;

a throttle slide movably mounted in said throttle control chamber for reciprocating motion therein;

a throttle needle connected to said throttle slide having a needle end for selective movement into and out of said gas outlet port of said metering chamber for controlling the flow of gas into said throttle bore;

a throttle cable operatively connected to said throttle slide for moving said throttle slide in said throttle control chamber.

26. The arrangement defined in claim 24 wherein:

said first preselected gas pressure range is on the order of 10 to 50 pounds per square inch.

27. The arrangement defined in claim 26 wherein:

said second preselected gas pressure range is on the order of 0.2 to 0.5 pounds per square inch.

28. The arrangement defined in claim 27 and further comprising:

a first stage pressure regulating chamber diaphragm cap mounted on said body member in regions adjacent said first stage pressure regulating chamber diaphragm;

a first stage diaphragm pressure plate bearing against said first stage diaphragm;

a first stage biasing spring intermediate said first stage diaphragm pressure plate and said first stage diaphragm for biasing said first stage diaphragm towards said first stage pressure regulating chamber gas inlet port;

a first stage screw member having a first end bearing against said first stage biasing spring and a second end threadingly engaging said first stage pressure regulating chamber diaphragm cap;

a control knob external said body member coupled to said first stage screw member for selectively compressing and relaxing said first stage biasing spring to selectively open and close said first stage gas inlet port.

29. The arrangement defined in claim 28 and further comprising:

a second stage pressure regulating chamber diaphragm cap mounted on said body member in regions adjacent said second stage pressure regulating chamber diaphragm;

a second stage biasing spring intermediate said second stage diaphragm pressure plate and said second stage diaphragm cap for biasing said second stage diaphragm towards said second stage pressure regulating chamber gas inlet port.

30. The arrangement defined in claim 29 wherein:

said first gas volume of said first stage pressure regulating chamber is on the order of 1.5 times the volume of said second gas volume of said second stage pressure regulating chamber.

31. The arrangement defined in claim 30 wherein:

said second gas volume of said second stage pressure regulating is on the order of 2.5 times the volume of said third gas volume of said metering chamber.

32. The arrangement defined in claim 31 wherein:

said first gas volume of said first stage pressure regulating chamber is on the order of 1.6 cubic inches;

said second gas volume of said second stage pressure regulating chamber is on the order of 1.0 cubic inches; and, said third gas volume of said metering chamber is on the order of 0.4 cubic inches.

33. The arrangement defined in claim 32 wherein:

said first stage pressure regulating chamber has a surface area on the order of 8.7 square inches;

said second stage pressure regulating chamber has surface area on the order of 7.5 square inches; and, said metering chamber has a surface area on the order of 3.2 square inches.

34. A carburetor for connection to a gas powered engine for receiving gas phase and/or liquid phase and or a mixture of gas phase and liquid phase of liquified petroleum gas from a liquified petroleum gas storage container wherein the liquified gas storage container has both a liquid phase and a gas phase of said liquified gas therein and said gas phase is at a storage gas pressure on the order of 150 pounds per square inch, and comprising, in combination:

a body member;

first walls in said body member defining a first stage pressure regulating chamber in said body member having a first stage gas inlet port for receiving at least one of a gas phase, a mixture of gas phase and liquid phase and liquid phase of liquified petroleum gas from the liquified petroleum storage bottle, a first stage diaphragm movably mounted in said first stage pressure regulating chamber for regulating the gas pressure of the gas in said first stage pressure regulating chamber in a first preselected gas pressure range less than said storage gas pressure, and said first stage pressure regulating chamber having a first gas volume and a first surface area;

second walls in said body member defining a second stage pressure regulating chamber in said body member for receiving gas from said first stage pressure regulating chamber, a second stage diaphragm movably mounted in said second stage pressure regulating chamber for regulating the gas pressure of the gas in said second stage pressure regulating chamber in a second preselected gas pressure range, lower than said first preselected gas pressure range, and said second stage pressure regulating chamber having a second gas volume less than said first gas volume of said first stage pressure regulating chamber and a second surface area less than said first surface area;

first gas flow passage walls in said body member defining a first gas flow passage providing communication between said first stage pressure regulating chamber and said second stage pressure regulating for allowing the flow of gas from said first stage pressure regulating chamber into said second stage pressure regulating chamber;

third walls in said body member defining a metering chamber in said body member having a metering chamber gas inlet port providing a gas flow passage into said metering chamber for accepting a gas flow from said second stage pressure regulating chamber, a metering chamber diaphragm for operatively connected to a metering chamber gas flow lever, a metering needle having a first end, a body portion, a second end and a neck portion connecting said second end to said body portion and said metering chamber gas flow lever movably connected to said neck portion of said metering needle and said gas inlet port having a conical seating surface for selective engagement and disengagement with said conical first end of said metering needle for the movement of said metering chamber gas flow lever towards and away from said gas inlet port of said metering chamber for metering the flow of gas through said metering chamber and said metering chamber having a third gas volume less than said second gas volume.

35. The arrangement defined in claim 34 wherein:

said first gas volume of said first stage pressure regulating chamber is on the order of 1.6 times the volume of said second gas volume of said second stage pressure regulating chamber and said second gas volume of said second stage pressure regulating chamber is on the order of 2.5 times said third gas volume of said metering chamber.

36. The arrangement defined in claim 34 wherein:

said first preselected gas pressure in said first stage pressure regulating chamber is in the range of 10.0 to 50.0 pounds per square inch;

said second preselected gas pressure in said second stage pressure regulating chamber is on the order of 0.5 pounds per square inch; and, said gas pressure in said metering chamber is in the range of atmospheric pressure to a small vacuum pressure.

37. The arrangement defined in claim 34 wherein:

said first gas volume of said first stage pressure regulating chamber is on the order of 1.6 cubic inches, and said first stage pressure regulating chamber has a surface area on the order of 8.7 square inches;

said second gas volume of said second stage pressure regulating chamber is on the order of 1.0 cubic inches, and said second stage pressure regulating chamber has a surface area on the order of 7.5 square inches; and, said third gas volume of said metering chamber is on the order of 0.4 cubic inches, and said metering chamber has a surface area on the order of 3.2 square inches;

said first stage pressure regulating chamber diaphragm has an inner surface facing said first stage pressure regulating chamber and an outer surface facing away from first stage pressure regulating chamber;

a first stage pressure regulating chamber diaphragm cap mounted on said body member in regions adjacent said outer surface of said first stage pressure regulating chamber diaphragm;

a first stage diaphragm pressure plate bearing against said outer surface of said first stage diaphragm;

a first stage biasing spring intermediate said first stage diaphragm pressure plate and said first stage diaphragm for biasing said first stage diaphragm towards said first stage pressure regulating chamber gas inlet port;

a first stage screw member having a first end bearing against said first stage biasing spring and a second end threadingly engaging said first stage pressure regulating chamber diaphragm cap;

a control knob external said body member coupled to said first sage screw member for selectively compressing and relaxing said first stage biasing spring to selectively open and close said first stage gas inlet port; and, wherein said body member is mounted in heat receiving relationship to the engine.

* * * * *